US009371600B2

(12) United States Patent
Barth et al.

(10) Patent No.: US 9,371,600 B2
(45) Date of Patent: Jun. 21, 2016

(54) DEVICE AND METHOD FOR PRODUCING KNITTED FABRIC

(75) Inventors: Johannes Barth, Niederwiesa (DE); Hermann Schmodde, Horb am Neckar (DE); Stephan Geiler, Oberlunwitz (DE); Michael Lau, Chemnitz (DE)

(73) Assignee: Terrot GmbH, Chemnitz (DE)

( * ) Notice: Subject to any disclaimer, the term of this patent is extended or adjusted under 35 U.S.C. 154(b) by 119 days.

(21) Appl. No.: 14/342,902

(22) PCT Filed: Sep. 6, 2012

(86) PCT No.: PCT/IB2012/054599

§ 371 (c)(1),
(2), (4) Date: Mar. 5, 2014

(87) PCT Pub. No.: WO2013/035056

PCT Pub. Date: Mar. 14, 2013

(65) Prior Publication Data

US 2014/0237984 A1 Aug. 28, 2014

(30) Foreign Application Priority Data

Sep. 8, 2011 (DE) ..... 10 2011 053 396

(51) Int. Cl.

| | |
|---|---|
| ***D01H 5/28*** | (2006.01) |
| ***D04B 9/14*** | (2006.01) |
| ***D04B 15/38*** | (2006.01) |
| ***D04B 15/48*** | (2006.01) |

(52) U.S. Cl.

CPC .. *D01H 5/28* (2013.01); *D04B 9/14* (2013.01); *D04B 15/38* (2013.01); *D04B 15/48* (2013.01)

(58) Field of Classification Search

CPC ..... D01H 5/28; D04B 15/38; D04B 15/48
USPC ..... 57/315, 328, 350
See application file for complete search history.

(56) References Cited

U.S. PATENT DOCUMENTS 4,183,202 A * 1/1980 Morihashi ..... D01H 1/115 57/289
4,768,336 A * 9/1988 Stahlecker ..... D01H 1/115 28/273

(Continued)

FOREIGN PATENT DOCUMENTS

DE 10 2006 006502 A1 8/2007
DE 10 2006 037714 A1 2/2008

(Continued)

OTHER PUBLICATIONS http://hydraulicspneumatics.com/other-technologies/book-2-chapter-14-proportional-control-valves, Book 2, Chapter 14: Proportional control valves (Jun. 8, 2009).*

*Primary Examiner* — Shaun R Hurley
(74) *Attorney, Agent, or Firm* — Michael J. Brown

(57) ABSTRACT

A device for producing knitted fabric comprising a knitting machine and a roving drawing and strengthening unit. The roving drawing and strengthening unit has a roving supply unit, through which a roving can be provided in the form of a fiber bundle that has not been strengthened, a stretching unit, to which the roving can be fed in a conveying direction in the form of at least one sliver, and a spinning nozzle device, through which compressed air can be applied to a drawn roving exiting the stretching unit in a fiber strengthening segment.

21 Claims, 16 Drawing Sheets

(56) References Cited

U.S. PATENT DOCUMENTS 4,893,461 A * 1/1990 Artzt ..... D01H 15/002 57/261
6,128,832 A * 10/2000 Stueble ..... D03J 1/008 19/66 CC
6,370,858 B1 * 4/2002 Mori ..... D01H 1/115 57/12
6,655,122 B2 * 12/2003 Shigeyama ..... D01H 1/115 57/264
6,694,565 B2 * 2/2004 Medeiros ..... D01H 11/005 15/301
7,926,306 B2 * 4/2011 Koenig ..... D01H 1/00 66/9 B
2004/0103633 A1 * 6/2004 Pyra ..... D02G 1/0273 57/280
2006/0096271 A1 * 5/2006 Yamamoto ..... D01H 1/115 57/350
2006/0236673 A1 * 10/2006 Schweier ..... D01H 1/115 57/350

FOREIGN PATENT DOCUMENTS

DE 10 2006 062364 A1 6/2008
DE 10 2007 052190 A1 4/2009
WO 2004/079068 A2 9/2004
WO 2007/093166 A2 8/2007
WO 2009/043187 A1 4/2009

* cited by examiner

DEVICE AND METHOD FOR PRODUCING KNITTED FABRIC

FIELD OF INVENTION

The present invention relates to a device for producing knitted fabric, comprising a knitting machine and at least one roving drawing and strengthening unit. The at least one roving drawing and strengthening unit has a roving supply unit, by means of which a roving can be provided in the form of a fibre bundle that has not been strengthened, a stretching unit, to which the roving can be fed in a roving conveying direction in the form of at least one sliver, and a spinning nozzle device by means of which pressurised air can be applied to a drawn roving exiting the stretching unit in a fibre strengthening segment. The invention further relates to a method for producing knitted fabric by means of a knitting machine and at least one roving drawing and strengthening unit, by means of which a roving is provided by a roving supply unit in the form of a fibre bundle that has not been strengthened, the roving is fed to a stretching unit in a roving conveying direction in the form of at least one sliver, the roving is drawn by the stretching unit, and pressurised air is applied to the drawn roving exiting the stretching unit by a spinning nozzle device in a fibre strengthening segment and said roving is thus strengthened.

BACKGROUND OF THE INVENTION

A device and a method of the aforementioned generic type are known from document WO 2009/043187 A1. This document proposes a method and device for producing knitted fabric, in which a fibre bundle, which has been drawn to the desired fineness in an upstream stretching system, is laid in front of each of the knitting needles of a knitting machine. On the segment between the stretching system and the knitting needles, the fibre bundle is transported by a pneumatically operating spinning nozzle. By means of the spinning nozzle, the fibre bundle is strengthened in such a way that twining fibres entwine a core of the fibre bundle, in which the fibres are substantially twist-free and orientated largely mutually parallel. In this context, the core of the fibre bundle comprises the greatest proportion of the fibres with respect to the cross-section thereof. The twining fibres entwine the core, and overlap and snag on one another. The resulting strengthening of the fibre bundle is not equivalent to effective yarn twisting, such as can be achieved for example on ring spinning frames. Instead, the spinning nozzle merely forms what is known as a false strand, the twist of which would more or less release if the fibre bundle entwined with twining fibres subsequently had to pass over longer transport segments onto the spinning nozzle on the way to the knitting machine.

Therefore, in document WO 2009/043187 A1, a tube, through which the entwined fibre is provided directly to the knitting needles of the knitting machine on a short path, is used directly after the spinning nozzle. By means of the knitting needles, the fibre bundle subsequently undergoes definitive strengthening within the produced knitting fabric. The known method has the advantage that it can achieve a particularly soft feel of the produced knitted fabric by using a fibre bundle which is merely peripherally strengthened.

However, it is disadvantageous that in document WO 2009/043187 A1 it is always necessary to position the knitting needles of the knitting machine as close as possible to the spinning nozzle. Although technically speaking this is in principle possible, it is not expedient in practice. Accordingly, the technology disclosed in document WO 2009/043187 A1, with which it is not possible to achieve sufficient strength of the fibre bundle for conventional further processing of the fibre bundle, has not been successful in practice.

Document DE 10 2006 037 714 A1 discloses a device for producing a knitted fabric, in which each knitting position of the knitting device is upstream from a stretching unit for producing a drawn fibre bundle. In this context, at least one active transport element for the drawn fibre bundle is arranged between the output roller pair of the stretching unit and the knitting position. The active transport element may consist of a supply unit, which is formed for example of a pair of rollers. In this context, one or more twisting devices, depending on the distance, are arranged between the output roller pair of the stretching unit and the active transport element, and give the fibre bundle, which basically consists of parallel fibres, sufficient strength for transport to the knitting position. Spinning tubes, each comprising a pneumatically operating twisting nozzle, are proposed as twisting devices. If the distance between the active transport element and the knitting position is smaller than the average fibre length of the drawn fibre bundle, the fibre bundle can be supplied to the knitting position directly. However, if this distance is larger than the average fibre length, another, further twisting device is arranged between the active transport element and the knitting position, and gives the drawn fibre bundle sufficient strength for the transport.

Further, document WO 2007/093166 A2 discloses a circular knitting machine for producing a knitted fabric from fibrous material, in which stretching units are assigned to the stitch formation positions of the circular knitting machine. In this context, it is proposed to equip the stretching units with straps, which are formed longer than is conventional in the transport direction of the stretching unit and to which a gripping device is assigned, which is axially displaceable in the transport direction and which produces an additional gripping zone in the primary drawing zone of the stretching unit in the gap formed by the straps. As a result, the conventional degree of gripping can be adapted to the length of the fibres used, so as to improve the uniformity of the fibrous materials exiting the stretching unit.

Document DE 10 2007 052 190 A1 includes a method and a device for improving the quality of a fibre bundle made of staple fibres leaving a stretching unit. In this context, it is proposed to arrange a sensor, for the fibre band or roving entering the stretching unit, upstream from the stretching unit. As a result, the quality of the fibre bundle or process upstream from the stretching unit can be monitored and weak points can be eliminated there. Moreover, if mass fluctuations of the fibre bundle or roving are detected, the stretching unit or a downstream stretching device can be stopped.

SUMMARY OF THE INVENTION

Therefore, the object of the present invention is to provide a device and a method with which knitted fabric, which is distinguished by a particularly soft feel and fullness, can be produced on an industrial scale in a practical and efficient manner.

According to the invention, this object is achieved, on the one hand, by a device of the aforementioned generic type, in which a gripping roller pair, which delimits the fibre strengthening segment and of which the gripping rollers can be rotated in opposite directions, is provided downstream from the spinning nozzle device, the gripping roller pair forming a clamping passage for the drawn, strengthened roving exiting the spinning nozzle device, and a feed to the knitting machine for the drawn, strengthened roving exiting the gripping roller pair being provided after the gripping roller pair.

Thus, according to the invention, a gripping point, which can be implemented by way of the gripping roller pair and which delimits the fibre strengthening segment, is provided downstream from the spinning nozzle device. In this context, according to the invention, the gripping point can be arranged at a relatively small distance from the spinning nozzle device, whilst the distance between the gripping roller pair and the knitting needles of the knitting machine, in other words the distance between the spinning unit and the knitting unit, is of a size which is expedient in practice.

The gripping roller pair makes it possible to decouple the technical system for roving drawing and roving strengthening from the system for supplying the fibres to the knitting machine, in terms of speed. In this context, the gripping point formed by the gripping roller pair blocks the false strand formation implemented by the spinning nozzle device. In other words, the gripping roller pair defines an end of the twists brought about by the spinning nozzle device and thus an end of the false strand. In this way, the gripping roller pair ensures that the drawn, strengthened roving exiting the gripping roller pair maintains the strength thereof. This in turn means that the drawn, strengthened roving exiting the gripping roller pair does not have to be supplied to the knitting needles via a tube, as in the prior art, but can instead be transported freely over a relatively large segment to the knitting needles of the knitting machine. A much better spatial separation between the spinning unit on the one hand and the stretching unit on the other hand is thus also possible according to the invention.

Moreover, the gripping point provided by the gripping roller pair also makes it possible to deflect the drawn, strengthened roving exiting the gripping roller pair into the work plane of the knitting machine.

Thus, with the device according to the invention, a drawn, strengthened roving can be provided on the roving drawing and strengthening unit, and only the periphery thereof is strengthened by the spinning nozzle device, twining fibres entwining a core of the roving, in which the fibres are substantially twist-free and orientated largely mutually parallel. In this context, the core of the fibre bundle comprises the greatest proportion of the fibres with respect to the cross-section thereof. The twining fibres entwine the core periphery, and overlap and snag on one another.

By means of the feed provided after the gripping roller pair, this soft, full, but nevertheless drawn and strengthened roving can be supplied via a segment, which expediently for industrial applications is long, to the knitting machine where a particularly soft and full knitted fabric can be produced using this drawn, strengthened roving.

The device according to the invention is distinguished in that, although the knitting machine can be arranged at some distance from the roving drawing and strengthening unit, very reliable and efficient work is possible using the device, since the gripping roller pair results in long-term stability of the strengthening of the roving.

DESCRIPTION OF THE INVENTION

In an advantageous embodiment of the invention, the rotational speed of at least one gripping roller of the gripping roller pair can be altered. In this way, the tension condition of the drawn, strengthened roving can be set sensitively in the region between the spinning nozzle device and the gripping point formed by the gripping roller pair.

In a preferred application of the device according to the invention, the distance between the spinning nozzle device and the gripping roller pair is in a range from 10 cm to 25 cm. This distance is great enough to make sufficient entwining of the core of the roving with twining fibres possible, in such a way that sufficient peripheral strengthening of the roving can be achieved. In this way, the gripping roller pair may for example be provided directly above the spinning nozzle device.

For example, in a variant of the present invention, the distance between the gripping roller pair and the knitting needles of the knitting machine is in a range of 1 m to 2.5 m. In other words, in this embodiment the knitting machine can be arranged at a sufficient distance from the roving drawing and strengthening unit which is to be considered a modified spinning unit. In this way, the knitting unit on the one hand and the spinning unit on the other hand can be arranged in a manner, which is expedient in practice, at a sufficient distance from one another in a production hall.

In a particularly preferred embodiment of the present invention, the spinning nozzle device comprises spinning nozzles which automatically convey the drawn roving in the roving conveying direction. In other words, the transport of the drawn roving takes place during the spinning process by way of the airflow, which is orientated in the working direction, of the spinning nozzle device. Thus, the spinning nozzle device, which is used according to the invention, is able to start spinning by itself. This is not possible in the device of document WO 2009/043187 A1. In this device, the spinning nozzle disclosed therein cannot convey yarn forwards out of the spinning nozzle, in other words cannot start spinning.

It is particularly preferred to form the device according to the invention in such a way that the spinning nozzle device comprises two pneumatically operating spinning nozzles having opposite directions of rotation, which are arranged in succession in the roving conveying direction. In this context, the spinning nozzle device preferably consists of two air turbulence nozzles. The airflows generated in the two spinning nozzles have opposite directions of rotation. In this context, the torsion nozzle arranged as the second spinning nozzle in the roving conveying direction creates a false strand on the supplied fibrous material, optionally including an auxiliary thread introduced into the fibrous material. The spinning nozzle which is arranged upstream from the torsion nozzle in the yarn conveying direction, the injector nozzle, brings about the twisting of the fibrous material as a result of the opposite direction of rotation. This results in a splaying of edge fibres. These are wound around the fibre bundle core as a result of the rotation produced by the torsion nozzle. Fibre belts, in other words fibres integrated horizontally with respect to the yarn axis, are typical of the resulting yarn. As a result of the very high rotational speeds of the air, edge fibres are continuously wound around the fibre bundle core. As a result, the drawn, strengthened roving exiting the spinning nozzle device has a soft, voluminous core, the periphery of which is strengthened by the edge fibres wound around the core.

It has been found to be favourable if the intensity of rotation and/or the pressure of the pressurised air exiting the spinning nozzles of the spinning nozzle device can be set to different values. As a result, the operation of the spinning nozzles can be used for example to influence the quality of the knitted fabric and/or to tune the spinning speed to the knitting speed of the knitting machine.

In an advantageous configuration of the device according to the invention, proportional valves, by means of which the pressurised air supply can be set in proportion to the roving conveying speed of the roving drawing and strengthening unit, are integrated into the pressurised air supply of spinning nozzles of the spinning nozzle device. In this variant of the invention, the spinning nozzles which operate as injector nozzles and the spinning nozzles, which operate as torsion nozzles, can each be combined in series to form a nozzle complex. Proportional valves are integrated into the pressurised air supply of both nozzle complexes. These are used for failure-free starting and stopping of the roving strengthening for subsequent processing on a knitting machine. The pressurised air supply of the nozzle complex is already required before the start of the roving strengthening because of the short reaction times upon machine start-up. The proportional valves interposed in the pressurised air supply prevent the spinning device from producing twists by way of air jets even when the technical system is switched off. This prevents overtwisting of the fibrous material, which is already present in the spinning nozzle system, in the spinning nozzles, as a result of a lack of supply of fibrous material by the stretching unit. This would rapidly lead to damage to and destruction of the newly formed strengthened roving. However, using proportional valves means that a failure-free start-up and shutdown process of the knitting machine is possible without thread breakage since the proportional valves make it possible to control the air supply in proportion to the rotational speed.

As a result of the high production speeds of the yarn production from fibrous material, the components of the device according to the invention are exposed to high loads. To increase the performance of the device, an embodiment of the invention provides that spinning nozzles of the spinning nozzle device can be changed laterally. This results in a thread progression between the roller pairs of the stretching unit and the gripping roller pair, which varies over time. In other words, the roving or the drawn roving is not in constant contact with the same contact face of the rollers. The used rubber upper rollers are prevented from entering the stretching unit and the gripping roller pair. So as always to ensure reliable guidance of the roving or the drawn roving, a defined changing path is preferably provided. Advantageously, the change extends over a plurality of roving drawing and strengthening units assembled in series.

As a result of the technological process of yarn production carried out on the device according to the invention by means of twist generation of air jets in the spinning nozzle device, shorter fibres are sometimes completely cut off from the treated roving. These fibres are ejected by the airflow of the spinning nozzles and form loose fibre. To keep the technical system clean and increase the performance, an embodiment of the present invention therefore provides an extractor device for extracting loose fibres on the spinning nozzle device.

In an advantageous embodiment of the invention, a suction unit is provided in each case between the spinning nozzles of the spinning nozzle device, downstream from the spinning nozzle device, and on an output roller pair of the stretching unit, the outputs of the suction units being combined into an extraction duct. In this context, the suction units provided between the spinning nozzles and downstream from the spinning nozzle device are preferably designed in such a way that they do not damage the drawn roving in the process. Because all of the suction units are combined into an extraction duct, the loose fibre can be channelled off centrally.

In this context, the extraction duct is preferably conical in form, so as to ensure uniform flow relationships over the width of the system.

As part of the general cleaning of the device according to the invention, a rotating ventilation device is provided thereon, and can for example be attached to and controlled by the knitting machine. The ventilation device provides a uniform distribution of the loose fibre which is not extracted. An accumulation of fibres, which might lead to process failure, is thus prevented. So as to protect the region around the spinning nozzle device from air turbulences resulting from the ventilation device, an embodiment of the present invention therefore provides a cover device around the spinning nozzle device. Preferably, this cover device also protects a region of the stretching unit. This has the result that the points of the device which are protected by the cover device can be protected from indefinite amounts of fibre at the stretching unit output and an associated fluctuation in yarn fineness, from soiling of the machine as a result of additional loose fibre, and from an accumulation of loose fibre and an associated failure of the roving strengthening process.

For further increasing the stability of the device according to the invention, in a favourable embodiment of the device blowing nozzles, which can be operated in time intervals, are provided on the spinning nozzles device and/or on the stretching unit. As a result of the sporadic operation of the blowing nozzles, the pressurised air consumption can be reduced.

Preferably, the blowing nozzles are integrated into the cover device.

It is especially advantageous if the stretching unit of the device according to the invention is coupled to an auxiliary thread supply device for supplying at least one auxiliary thread.

The auxiliary thread may on the one hand be an inflexible thread or on the other hand be a spandex thread, in other words a resilient thread. By using an auxiliary fibre, the strength of the drawn, strengthened roving supplied to the knitting machine can be increased and the stability of the process carried out on the device according to the invention can be increased. If an auxiliary fibre is supplied to the roving treated in the device according to the invention, a core/sheath yarn is produced, the core being formed by the auxiliary thread.

Preferably, the auxiliary thread supply device comprises an outlet formed by an output roller pair of the stretching unit. As a result, the auxiliary thread can be received through the output roller pair of the stretching unit and integrated into the drawn roving. Because the auxiliary thread is only supplied during the primary drawing of the stretching unit, the auxiliary thread only passes through one gripping point on the stretching unit. The speed of the auxiliary thread supply can thus be tuned optimally to the rotational speed of the output roller pair.

In an advantageous embodiment of the present invention, the proportion by mass of the auxiliary thread in the drawn, strengthened roving exiting the gripping roller pair is 5 to 25%. In this way, the drawn, strengthened roving is given sufficient strength, but the softness and fullness of this roving are not or are barely compromised.

It has been found to be particularly favourable if the auxiliary thread supply device comprises a tube system through which at least one auxiliary thread can be supplied to the stretching unit. An arrangement of this type is to be recommended in particular if the auxiliary thread is an inflexible thread. By way of the tube system, the auxiliary thread can be supplied to the stretching unit without drawing and thus without damage.

If the auxiliary thread is a spandex thread, it is particularly advantageous if the auxiliary thread supply device comprises a separate drive, in such a way that the spandex thread can be supplied to the stretching unit at a defined tension.

It is also favourable if, in an embodiment of the present invention, the auxiliary thread or threads are provided on supply bobbins arranged in a bobbin creel and can be supplied by these to the stretching unit. In this way, the auxiliary thread can be released from storage, the storage of the auxiliary thread being provided by the bobbin creel.

In a particularly suitable variant of the present invention, at least one sensor for detecting the presence, thickness and/or tension of the roving and/or auxiliary thread is provided on at least one transport segment of the roving, of the drawn, strengthened roving and/or of the auxiliary thread from the roving supply unit to the stretching unit and/or from the gripping roller pair to the knitting machine and/or in the auxiliary thread supply device. In this way, the roving treatment procedure and the quality of the roving treated on the device according to the invention can be monitored by means of the at least one sensor. This sensor may for example be used for selecting "thick points" or cross-sectional enlargements of the treated roving. With the at least one sensor, the presence of the roving and/or auxiliary thread can also be detected, this being single-thread monitoring. However, the at least one sensor can also be used for example for monitoring a skein of slivers, one sensor monitoring all of the slivers in one plane in each case. In this case, a presence sensor is typically used, and ensures the guaranteed presence of the auxiliary thread. This type of monitoring of the auxiliary thread can be used both for inflexible and for resilient auxiliary threads.

It is particularly helpful if, in accordance with an embodiment of the device according to the invention, a sliver clamp, which clamps the sliver when the stretching unit lever is open and releases the sliver when the stretching unit lever is closed, pressing the nip rolls of the stretching unit against the drive rollers of the stretching unit, and which comprises a curved resilient body, is provided between rollers of the stretching unit. The sliver clamp serves to secure the sliver when the stretching unit is opened. Thus, when the stretching unit lever is opened, no spring force acts on the nip rolls. Likewise, there is no longer any holding force acting on the sliver. As a result of the arrangement of the stretching unit in a vertical orientation, the sliver would fall downwards under the force of gravity and cause the process to be interrupted. However, with the curved resilient body thereof, the sliver grip is of a construction which makes it possible to grip the sliver securely when the stretching unit lever is open. This secures the precise position of the sliver. Further, it makes it possible for the curved resilient body of the sliver grip to release the sliver when the stretching unit lever is closed. In this context, the sliver grip is configured in such a way that it securely grips the sliver before the resilient force of the roller pairs for fixing said sliver becomes too low. During closing, the sliver grip likewise only opens and releases the sliver once there is sufficient contact force from the roller pairs. In a particularly suitable embodiment, the sliver grip is configured in such a way that it comprises two grips for securely grasping two slivers. The clamps of the sliver grip may for example be fixed to a rail in a modular construction.

Preferably, the roving drawing and strengthening unit of the device according to the invention is formed in such a way that the roving is supplied from the roving supply unit to the gripping roller pair from bottom to top, in other words counter to gravity. In other words, in a preferred embodiment of the device according to the invention, the stretching unit is arranged vertically. This has the advantage that the drawn, strengthened roving exiting the gripping roller pair can be supplied upwards to the roving drawing and strengthening unit from where it can be supplied to the knitting machine.

It is favourable for the feed, to the knitting machine, for the drawn, strengthened roving exiting the gripping roller pair to be provided sufficiently far up on the device for the drawn, strengthened roving to be fed to the knitting machine overhead. In this way, the drawn, strengthened roving can be supplied to the knitting needles of the knitting machine in a particularly suitable manner.

Since a plurality of threads have to be supplied to a knitting machine, a number of roving drawing and strengthening units are also required in the device according to the invention. In this context, in a particularly practical embodiment of the present invention, a number of roving drawing and strengthening units are assembled in series to form a roving drawing and strengthening module. This has the advantage that the roving drawing and strengthening units, which are assembled in series, can each use continuous stretching unit rollers and gripping rollers, and a large number of roving drawing and stretching units can thus be driven by a small number of drives.

In this context, it is particularly advantageous if the knitting machine is a circular knitting machine and at least two roving drawing and strengthening modules are provided around the circular knitting machine. In this way, the circular knitting machine can be supplied with threads from a plurality of sides.

In this embodiment, it is recommended for the control systems of the circular knitting machine and of the roving drawing and strengthening modules to be coupled together. In this way, the operating sequences of the roving drawing and strengthening modules can be optimally adapted to the operating sequences of a circular knitting machine, the circular knitting machine preferably providing the master signals for the roving drawing and strengthening units.

In a favourable development of the device according to the invention, a fournisseur, in other words a positive or storage feeding system, is provided between the gripping roller pair and a thread guide of the knitting machine for storing the thread. In this way, it can be ensured that a sufficient amount of the drawn, strengthened roving can always be supplied to the knitting machine.

The object of the present invention is further achieved by a method of the aforementioned generic type, in which a gripping roller pair, which is arranged downstream from the spinning nozzle device and of which the gripping rollers rotate in opposite directions, grips the drawn, strengthened roving exiting the spinning nozzle device, and as a result the fibre strengthening segment is delimited and the drawn, strengthened roving exiting the gripping roller pair is supplied to the knitting machine.

Thus, in the method according to the invention a roving in the form of a fibre bundle that has not been strengthened is used as a starting material. Because strengthening has not yet taken place, this roving is very soft and voluminous, but is also susceptible to tearing. This roving is supplied in the form of at least one sliver, particularly preferably in the form of two slivers, to the stretching unit, where it is drawn by corresponding rollers of the stretching unit. This drawn roving exiting the stretching unit is passed through the spinning nozzle device, in which pressurised air is applied thereto. The application of pressurised air is provided in such a way that twining fibres peripherally entwine a core of the drawn roving. This results in the formation of what is known as a false strand. As has also been described previously in the prior art, false strands of this type are only stable for a limited time since the fibres entwining the core of the roving are only arranged on the periphery of the roving as a result of a twist exerted on the roving by the spinning nozzle device. With increasing distance of the false strand from the spinning nozzle device, the twist typically gradually releases, meaning that the temporary strengthening as a result of false strand formation subsides little by little, or even completely disappears after a particular point.

This is not the case in the procedure according to the invention. Rather, in the method according to the invention, an end of the fibre strengthening segment after the spinning nozzle device is defined by the gripping roller pair provided there. As a result of the drawn, strengthened roving exiting the spinning nozzle device being gripped, the false strand formation is ended at the gripping point. Thus, there is no subsequent twisting of the twining fibres which strengthen the core of the drawn roving. Instead, the strengthening remains intact and the drawn, strengthened roving exiting the gripping roller pair can, according to the invention, be transported over relatively long segments to the knitting needles of the knitting machine, without the risk of this drawn, strengthened roving tearing on the transport segment from the gripping roller pair to the knitting machine.

This procedure provides major advantages over the prior art. Whereas in the prior art it was always necessary to position the knitting needles of the knitting machine as close as possible to the spinning unit, and this involves considerable problems in normal production operation, this is not necessary in the method according to the invention. Instead, the knitting machine can be arranged at a suitable distance from the roving drawing and strengthening unit, which acts as a spinning unit. In this way, it is for the first time possible in practice to combine the spinning with the knitting in one production unit.

So as to be able to adjust the tension condition of the drawn, strengthened roving in the region between the spinning device and the gripping point defined by the gripping roller pair, in a suitable manner, a variant of the method according to the invention provides that the rotational speed of at least one gripping roller of the gripping roller pair is adjusted in accordance with the desired tension condition.

In the method according to the invention, it is preferred for spinning nozzles of the spinning nozzle device to convey the drawn yarn in the yarn conveying direction automatically. In this way, the spinning nozzles are able to start spinning by themselves in this embodiment of the method according to the invention.

In a particularly expedient configuration of the method according to the invention, spinning nozzles of the spinning nozzle device operate pneumatically and apply pressurised air to the drawn roving exiting the stretching unit in respectively opposite directions of rotation, it being possible to set the tension condition of the drawn, strengthened roving in the region between the spinning nozzle device and the gripping roller pair, by adjusting the intensity of rotation and/or the pressure of the pressurised air exiting the spinning nozzles of the spinning nozzle device. In this way, the quality and above all the strength of the drawn, strengthened roving exiting the gripping roller pair can be set optimally, so as to be able to ensure a frictionless process sequence and to be able to produce a high-quality knitted fabric on the knitting machine.

Setting the pressurised air supply of spinning nozzles of the spinning nozzle device in proportion to the roving conveying speed of the roving drawing and strengthening unit, in accordance with an embodiment of the present invention, makes it possible to regulate the air supply to the spinning nozzle device to be proportional to the rotational speed. In this context, the necessary rotational speed signal can be provided by the knitting machine. As a result, it is possible to start up and shut down the knitting machine without damaging the fibrous material or treated roving.

It is particularly expedient to configure the method according to the invention in such a way that spinning nozzles of the spinning nozzle device are changed laterally during the operation of the roving drawing and strengthening unit. With this procedure, the rollers of the stretching unit and of the gripping roller pair are not always in contact with the treated roving at the same point. The material wear on the rollers can thus be made uniform, meaning that the roving drawing and strengthening units have a long service life and the method according to the invention can be carried out over long production periods without the need to replace the rollers.

So as to be able to keep the device clean while carrying out the method according to the invention, and thus increase the performance of the device, it is recommended, in an embodiment of the method according to the invention, to extract loose fibres using an extractor device provided on the spinning nozzle device.

In a particularly suitable variant of the method according to the invention, at least one ventilator of a ventilator device rotates on the device, a region around the spinning nozzle device and/or around the stretching unit being protected against air turbulences, which are brought about by the ventilator device, by a cover device. In this way, the roving can be both drawn and strengthened without damage as a result of loose fibres.

It has been found to be particularly expedient if, in a development of the method according to the invention, blowing nozzles are operated in time intervals on the spinning nozzle device and/or on the stretching unit. In this way, the device can be kept suitably clean and the pressurised air consumption can be reduced as a result of the sporadic operation of the blowing nozzles.

In a preferred embodiment of the method according to the present invention, at least one auxiliary thread is supplied to the stretching unit. An inflexible thread, in other words what is known as a core thread, or else a resilient thread, in other words what is known as a spandex thread, may be used as the auxiliary thread. By way of an auxiliary thread, higher stability can be provided for the roving treated by the method according to the invention.

It is particularly practical for the auxiliary threads to be drawn off by an output roller pair of the stretching unit. Since the rollers of the stretching unit move at a speed which varies over the course of the stretching unit, the auxiliary thread supplied to the output roller pair of the stretching unit is only exposed to a single rotational speed, and so the feed of the auxiliary thread can be adapted to this rotational speed in a suitable manner. At this point, the auxiliary thread can thus be introduced without difficulty between the fibres of the roving drawn by the stretching unit.

A further variant configuration of the method according to the invention provides that the auxiliary thread is supplied to the stretching unit through a tube system. In this way, the auxiliary thread can be protected during the transport thereof. In addition, this feed opens up the possibility of pneumatic auxiliary thread feed in the event of adjustment.

If a spandex thread is used as the auxiliary thread, it is expedient to supply it to the stretching unit using a separate drive. In this way, a highly resilient, preferably polyfil or multifil auxiliary thread can be supplied to the stretching unit at a defined tension.

The method according to the invention and the product produced thereby can be monitored particularly well if, in a preferred embodiment of the method according to the invention, the presence, the thickness and/or the tension of the roving and/or of the auxiliary thread are detected on at least one transport segment of the roving, of the drawn, strengthened roving and/or of the auxiliary thread from the roving supply unit to the stretching unit and/or from the gripping roller pair to the knitting machine and/or in the auxiliary thread supply device, by means of at least one sensor.

In a particularly advantageous development of the method according to the invention, the sliver is gripped by means of a sliver clamp provided between the rollers of the stretching unit and comprising a curved resilient body, when the stretching unit lever is open, and the sliver is released when the stretching unit lever is closed, pressing the nip rolls of the stretching unit against the drive rollers of the stretching unit. The sliver grip, which is mechanically coupled to the stretching unit lever, thus assists the stretching unit operation in the event of readjustment and fault elimination, and in particular prevents the roving from slipping off.

Preferably, the method according to the invention is configured in such a way that the roving is supplied from the roving supply unit of the gripping roller pair from bottom to top, in other words counter to gravity. As a result, the drawn, strengthened roving exiting the gripping roller pair appears above the roving drawing and strengthening unit and can thus be supplied to the knitting machine in a suitable manner.

In this context, it is particularly advantageous if the drawn, strengthened roving is supplied to the knitting machine overhead. In this way, it can be supplied to the knitting needles of the knitting machine in a particularly simple manner.

It is particularly practical to configure the method according to the invention in such a way that a number of roving drawing and strengthening units are assembled in series to form a roving drawing and strengthening module, the knitting machine is a circular knitting machine, and at least two roving drawing and strengthening modules are provided around the circular knitting machine and ensure the supply to the circular knitting machine, the circular knitting machine performing a master function for the roving drawing and strengthening modules. In this way, two, three or even more roving drawing and strengthening modules, which are arranged around the circular knitting machine, can provide the supply of drawn, strengthened roving to the circular knitting machine, the circular knitting machine establishing at what moment and to what extent the supply should be provided by each individual roving drawing and strengthening module. In this way, a very effective system can be provided.

In a variant of the method according to the invention, the system is adjusted or set in operation using roving drawing and strengthening units which are decoupled from the knitting machine, in that the roving drawing and strengthening units produce drawn, strengthened rovings in advance for introduction into a thread guide of the knitting machine.

In another variant of the method according to the invention, the system is adjusted or set in operation using roving drawing and strengthening units which are coupled to the knitting machine, in that an inflexible auxiliary thread is immediately introduced into a thread guide of the knitting machine and drawn, strengthened roving is subsequently added through the roving drawing and strengthening units. In this variant, once the knitting machine has been set in operation, the inflexible auxiliary thread is separated off again and held ready by gripping devices.

In a similarly expedient configuration of the method according to the invention, the drawn, strengthened roving exiting the gripping roller pair is stored on a feeding system, in other words a positive or storage feeding system. In this way, continuous supply of drawn strengthened roving produced by the roving drawing and strengthening unit to the knitting machine is ensured.

DESCRIPTION OF THE DRAWINGS

Preferred embodiments of the present invention and the construction, operation and advantages thereof are described in the following with reference to the drawings, in which.

DETAILED DESCRIPTION OF THE PREFERRED EMBODIMENTS

Figure 1:
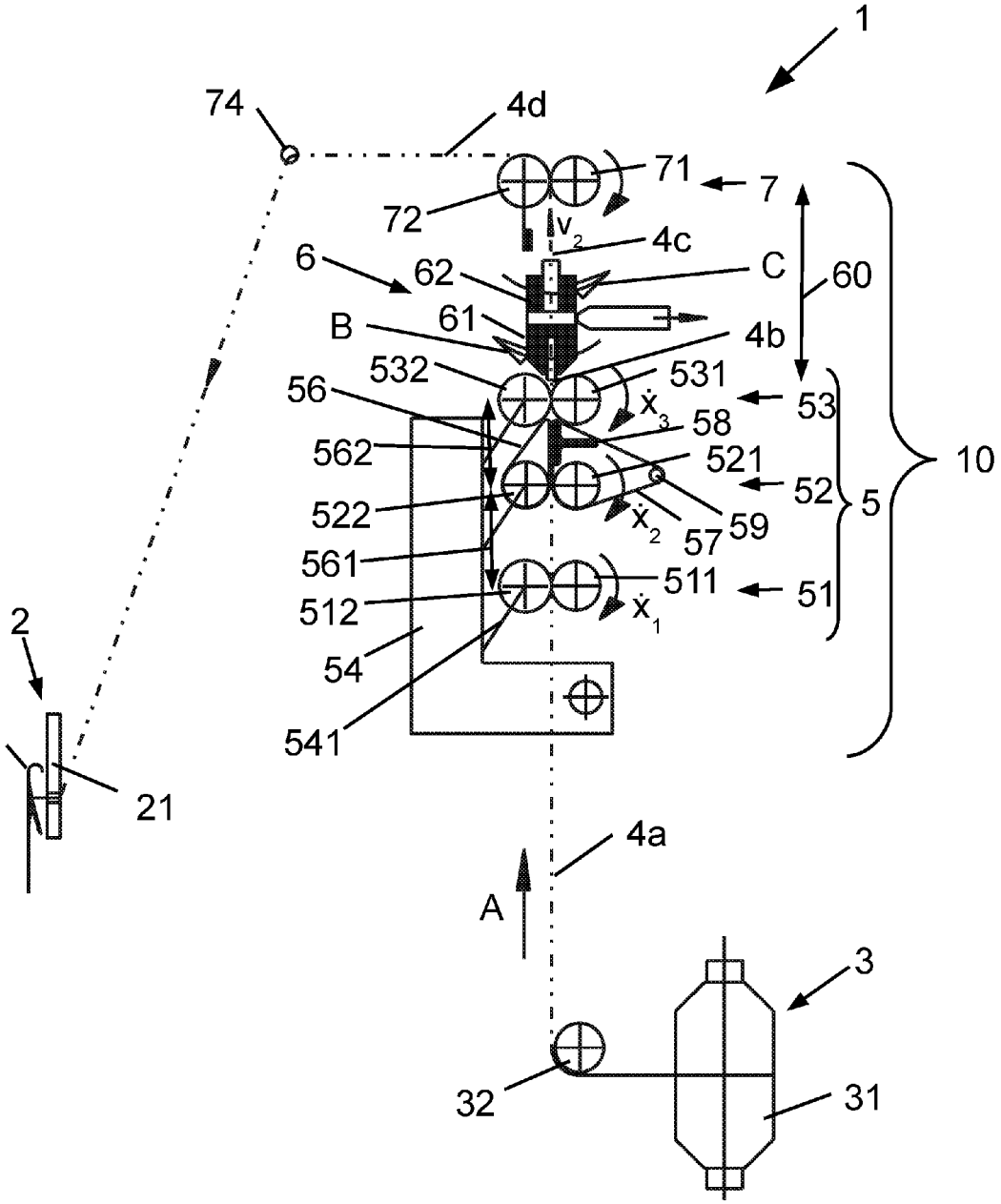
FIG. 1 schematically shows a possible embodiment of a device according to the invention for producing knitted fabric comprising a schematically shown roving drawing and strengthening unit and a feed to knitting needles of a knitting machine for the drawn, strengthened roving produced by the roving drawing and strengthening unit.

FIG. 1 is a schematic sectional side view of a possible embodiment of a device 1 according to the invention for producing knitted fabric, on which the method according to the invention for producing knitted fabric can be carried out.

The illustrated device 1 according to the invention initially comprises a roving supply unit 3, in which a roving 4*a*, which is in the form of a fibre bundle that has not been strengthened, is supplied to a roving drawing and strengthening unit 10 in a roving conveying direction A on what are known as flyer bobbins, of which only one flyer bobbin 31 is shown in the schematic drawing in FIG. 1, via at least one transport shaft 32.

The roving drawing and strengthening unit 10 comprises a stretching unit 5 and a spinning nozzle unit 6. In this context, the roving 4*a* provided by the roving supply unit 3 initially arrives in the stretching unit 5. The stretching unit 5 comprises an input roller pair 51 having an input shaft 511 and a nip roller 512, an intermediate roller pair 52 having an intermediate shaft 521 and an upper roller 522, and an output roller pair 53 comprising an output shaft 531 and a nip roll 532. In this context, the input shaft 511, the intermediate shaft 521 and the output 531 are driven shafts, which are operated at different speeds $\dot{x}_1$, $\dot{x}_2$, $\dot{x}_3$. The upper rollers and nip rolls 512, 522 and 532 are pressed against the drive rollers 511, 521 and 531 by means of a stretching unit lever 54 using springs 541.

The stretching unit 5 is what is known as a strap stretching unit. A strap system therefore is provided on the intermediate roller pair 52. The strap system provides defined acceleration of the roving 4*a* treated in the stretching unit 5 by controlled guidance. The strap system comprises an upper strap assembly 56 and a lower strap 57. The lower strap 57 passes over the intermediate shaft 521 and a strap bridge 58, as well as a tensioning element 59. The tensioning element 59 serves to set a correct lower strap tension. The force on the lower strap 57 results in a non-positive connection between said strap and the intermediate shaft 521. This makes it possible to drive the lower strap 57. The upper strap assembly 56 consists of a cage and a strap. The upper roller 522 and the upper strap assembly 56 are pressed onto the associated driven intermediate shaft 521 by way of defined resilient forces. The resulting non-positive connection brings about the movement.

Figure 16:
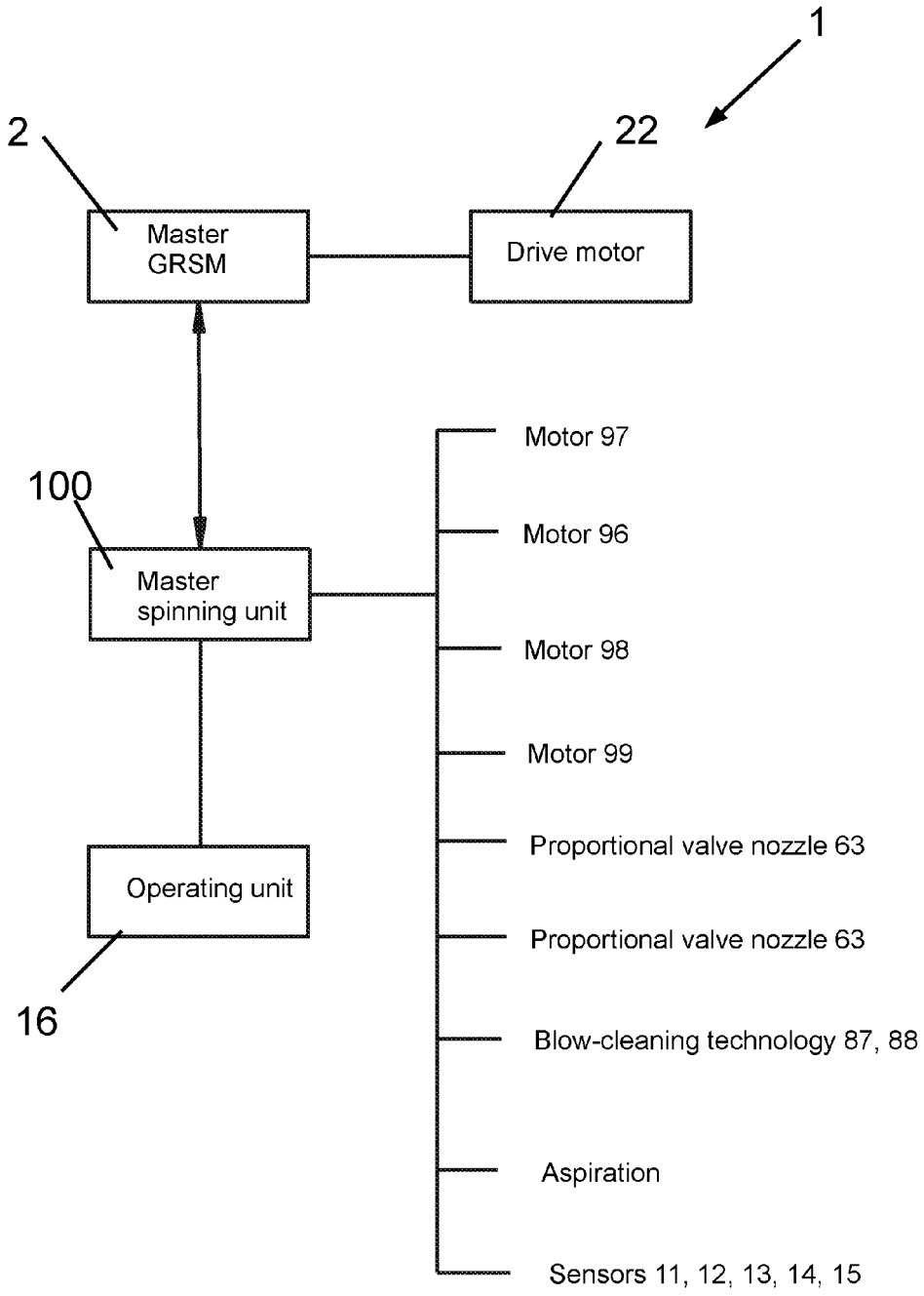
FIG. 16 is a schematic drawing of a possible construction concept for an embodiment of the device according to the invention for producing knitted fabric.

The input shaft 511 and the intermediate shaft 521 are powered by a shared drive 97 (see FIG. 16). In the embodiment shown, the output shaft 531 has its own drive 96 (see FIG. 16).

The vertical distance between the central points of the nip roll 512 of the input roller pair 51 and the upper roller 522 of the intermediate roller pair 52, in other words what is known as the front field distance 561, and the vertical distance between the central points of the upper roller 522 of the intermediate roller pair 52 and the nip roll 532 of the output roller pair 53, in other words what is known as the main field distance 562, can be adjusted for different fibre lengths of the starting material.

Figure 3:
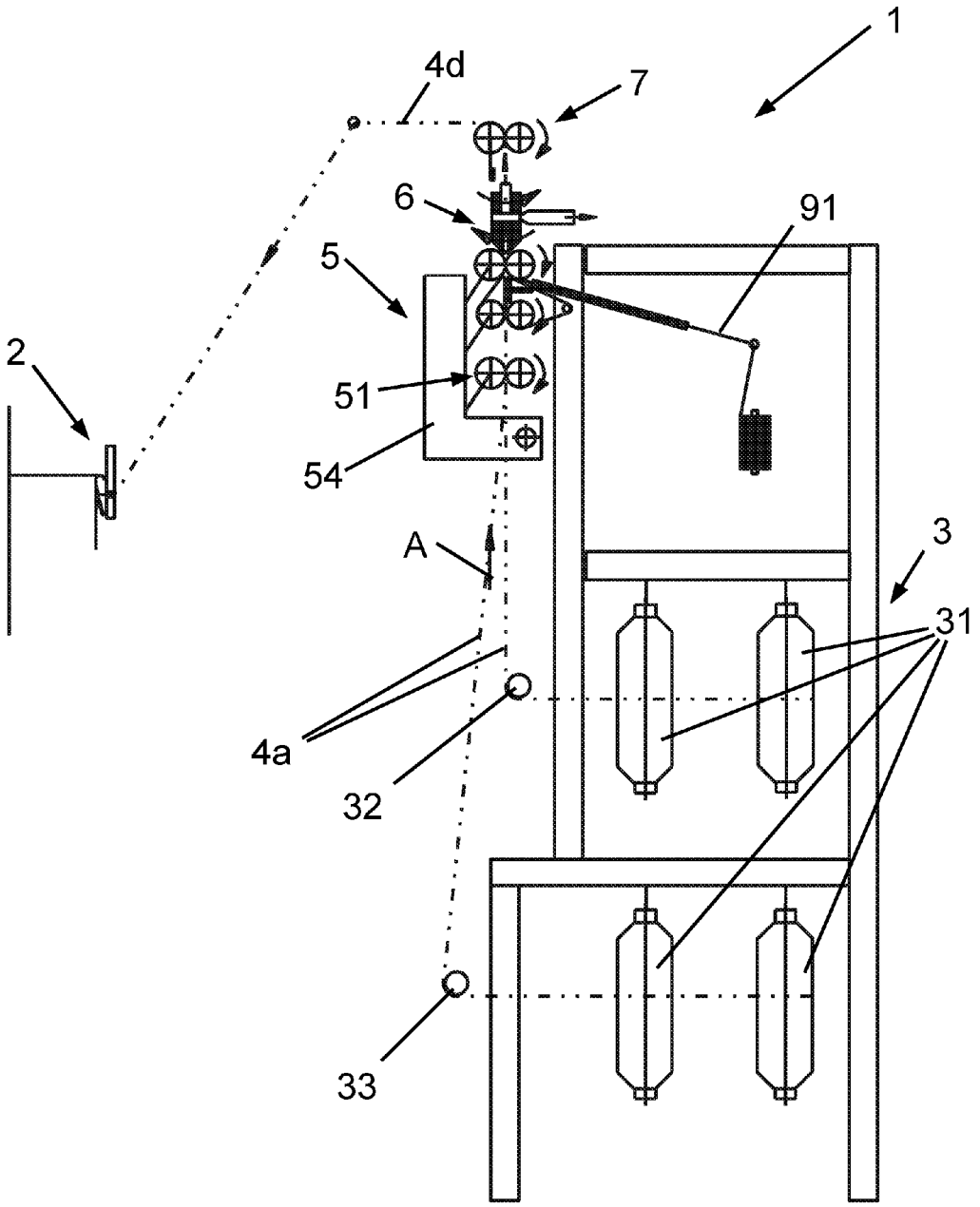
FIG. 3 schematically shows a further embodiment of the device according to the invention for producing knitted fabric, comprising roving which is stored on flyer bobbins and which is supplied to a roving drawing and strengthening unit of the device, and comprising an auxiliary thread supply device which supplies an auxiliary thread to a stretching unit of the roving drawing and strengthening unit.

Although only one sliver which is supplied to the stretching unit 5 is shown schematically in the embodiment of FIG. 1, in a particularly preferred embodiment of the device 1 according to the invention, as shown in FIG. 3, two flyer slivers (roving 4*a*) can be supplied to each stretching unit 5, to increase the performance by reducing the equipment complexity and to increase the yarn uniformity.

In the preferred embodiment shown, the working direction of the stretching unit 5 is vertically from bottom to top. The input roller pair 51 of the stretching unit 5 draws off the roving 4*a* radially. The roving 4*a* drawn off from the flyer bobbin 31 is deflected into the vertical work plane by the transport shaft 32, which is for example belt-driven. This shaft further makes failure-free transport of the roving 4*a* possible. The transport shaft 32 may for example be driven, using a corresponding transmission ratio, by the drive for the input shaft 511 of the input roller pair 51 and the intermediate shaft of the intermediate roller pair 52 of the stretching unit 5.

The roving 4*a* is subsequently drawn by the stretching unit 5. The stretching unit 5 has the purpose of providing a defined amount of fibre for the continuing process. The drawing required for this is implemented by the aforementioned different speed ratios of the series of roller pairs 51, 52, 53.

The advance drawing takes place between the input roller pair 51 and the intermediate roller pair 52. The subsequent primary drawing takes place between the intermediate roller pair 52 and the output roller pair 53. In this context, the speed of the roller pairs 51, 52, 53 increases in the vertically upward direction.

To produce the necessary work for drawing, the roving 4*a* (flyer sliver) has to be gripped, so as subsequently to be accelerated by the different speeds of the roller pairs 51, 52, 53 and thus drawn. This takes place by way of the above-disclosed construction of the stretching unit 5, which is composed of driven shafts 511, 521, 531 extending over the system and unpowered nip rolls 512, 522, 532 located opposite them, which each extend over a stretching unit 5.

Figure 2:
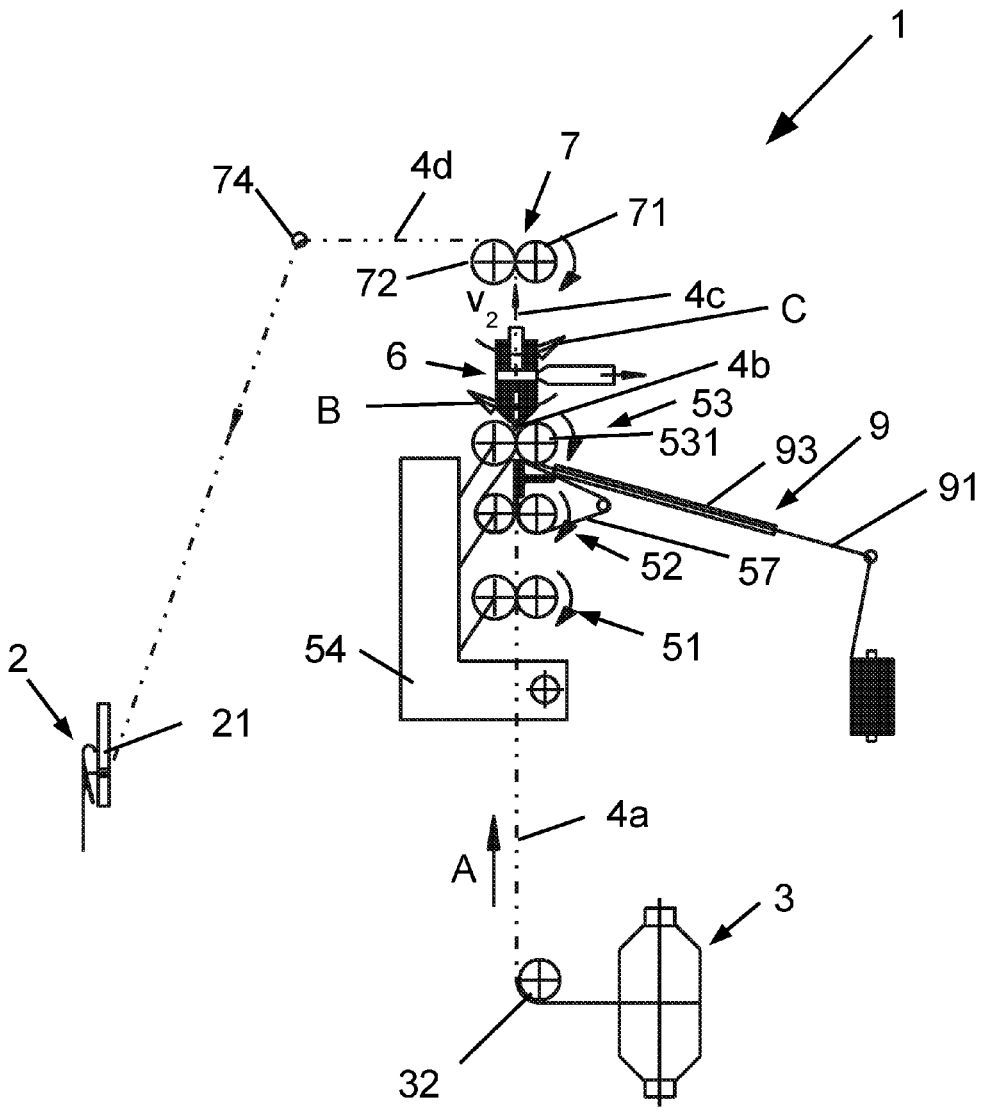
FIG. 2 schematically shows a development of the device according to the invention for producing knitted fabric, comprising an auxiliary thread feed to the roving drawing and strengthening unit.

FIG. 2 schematically shows an embodiment of the device 1 according to the invention comprising an additionally provided auxiliary thread supply device 9. The further elements of the embodiments shown both in FIG. 2 and in the following drawings of the device 1 according to the invention substantially correspond to those of FIG. 1. Therefore, like elements are also provided with like reference numerals, whilst for other elements of the device 1 the reference numerals have been omitted in FIG. 2 and the remaining drawings, for improved clarity. Reference is hereby made to the above descriptions for these elements which are identical to the elements of FIG. 1.

The auxiliary thread supply device 9 serves to increase the strength and the stability of the process carried out on the device 1. By means of the auxiliary thread supply device 9, an auxiliary thread 91 is supplied to the stretching unit 5, and in the example of FIG. 2 is an inflexible thread, in other words what is known as a core thread. In the example shown, the auxiliary thread 91 is supplied to the stretching unit 5 via a tube system 93. In the embodiment shown, the auxiliary thread 91 is fed between the lower strap 57 and the output shaft 531 from the rear side of the stretching unit 5. The auxiliary thread 91 is drawn off tangentially by way of the rotating output roller pair 53 of the stretching unit 5. Because the auxiliary thread 91 is only supplied during the primary drawing, it only passes through one griping point on the stretching unit 5. This ensures that the auxiliary thread 91 is supplied without drawing and thus without damage. The auxiliary thread 91 is integrated into the roving 4*a* drawn in the stretching unit 5. This results in a core/sheath structure of the roving 4*b* drawn from the stretching unit 5.

Referring to FIGS. 1 and 2, the drawn, strengthened roving 4*b* exiting the stretching unit 5, with or without an auxiliary thread 91 depending on the embodiment, subsequently enters the spinning nozzle device 6 downstream from the stretching unit 5. In the spinning nozzle device 6, the drawn roving 4*b* is twisted by means of air jets on a fibre strengthening segment 60.

In this context, the spinning nozzle device 6 consists of two spinning nozzles 61, 62 arranged in series, which are air turbulence nozzles. The airflows generated in the two spinning nozzles 61, 62 have opposite directions of rotation B, C. In this context, the second spinning nozzle 62, known as the twisting nozzle, downstream from the spinning nozzle 61, produces a false strand on the fed-in fibrous material, optionally including an auxiliary thread 91. As a result of the opposite rotational direction, the upstream spinning nozzle 61, known as the injector nozzle, brings about twisting of the fibrous material. This results in splaying of edge fibres. These are wound around the fibre bundle core as a result of the rotation produced by the spinning nozzle 62. Fibre belts, in other words fibres integrated horizontally with respect to the yarn axis, are typical of the resulting drawn, twisted roving 4*c*. As a result of the very high rotational speeds of the air which are provided by the spinning nozzle device 6, edge fibres are continuously wound around the fibre bundle core. The roving transport takes place during the spinning process as a result of the airflow orientated in the operating direction. As a result, a drawn, strengthened roving exits the spinning nozzle device 6 at a speed $v_2$.

The spinning nozzle device 6 operates as follows. Initially, the fibre belts are transferred onto the stretching unit output rollers 531, 532 by means of the suctional, rotating airstream provided by the spinning nozzle 61, which acts as a suction nozzle. The spinning nozzle 62, in other words what is known as the twisting nozzle, at a defined distance downstream from the spinning nozzle 61 generates a counter-rotating airflow. A barrier comprising a cross slit can be interposed between the spinning nozzle 61, 62, and serves to generate edge fibre twinings with the aim of real strengthening of the drawn, strengthened roving 4*c* exiting the spinning nozzle device 6. Preferably, ventilation zones for the incident exhaust air are provided between the spinning nozzles 61, 62 in connection with a discharging of incident impurities and short fibres. Suction is applied to these ventilation zones.

Both the spinning nozzles 61, 62 of the spinning nozzle device 6 and the interposed barrier are of a defined construction as regards the nozzle hole, the number of holes, the hole angle, the nozzle diameter, the nozzle design, the barrier cross and the barrier cross design. In preferred practical applications of the device 1 according to the invention, the spinning nozzles 61, 62 are assembled in nozzle complexes 67, 68 in the form of nozzle bars, as is shown in FIG. 6. Preferably, the pressurised air is supplied to the spinning nozzles 61, 62 with the interposition of adjustable throttle valves for ensuring constant pressure and flow relationships at all of the spinning nozzles 61, 62.

As is explained in greater detail in the following in relation to FIG. 6, the pressurised air control for the suction and twisting nozzles is favourably provided via pressure regulators and proportional valves for each bar, to ensure appropriate pressure relationships in the run-up and braking processes of the device according to the invention.

In the device 1 according to the invention, a gripping roller pair 7 is provided at a distance of approximately 15 to approximately 25 cm from the spinning nozzle device 6. The gripping roller pair 7 comprises two gripping rollers 71, 72 which can be rotated in opposite directions. In this context, the drawn, strengthened roving 4*c* exiting the spinning nozzle device 6 is passed through the gripping rollers 71, 72, which press against one another and form both a passage and a gripping point for the roving 4*c*. The gripping point formed by the gripping roller pair 7 delimits the fibre strengthening segment provided by the spinning nozzle device 6.

The modes of operation of the spinning nozzles 61, 62 and the rotational speed of the gripping roller pair 7 as well as the distance between the spinning nozzle device 6 and the gripping roller pair 7 are set in such a way that the tension condition of the drawn, strengthened roving 4*c* can be defined sensitively in the region between the spinning nozzle device 6 and the gripping point provided by the gripping roller pair 7.

The gripping roller pair 7 typically has a driven gripping roller 71 and a gripping roller 72, which presses against this driven gripping roller 71 and rotates as well despite having no separate drive. The gripping roller pair 7 makes it possible to decouple the speed of the technical system for roving drawing and roving strengthening from the system for supplying the thread to the knitting machine 2. Subsequently, the gripping point brought about by the gripping roller pair 7 brings about a deflection of the drawn, strengthened roving 4*d* exiting the gripping roller pair 7 into the working plane of the knitting machine 2. The drawn, strengthened roving 4*d* exiting the gripping roller pair 7 is subsequently supplied to a thread guide 21 of the knitting machine 2 via as few deflection points as possible, such as the deflection point 74 shown schematically in FIGS. 1 and 2, and integrated into the produced knitted fabric by way of the stitch-forming process.

FIG. 3 schematically shows a device 1 according to the invention which has been expanded compared to FIG. 2 and in which a plurality of flyer bobbins 31 are used for storing the roving 4*a*. The flyer bobbins 31 are integrated into the construction of the technical system. The integration greatly reduces soiling of or damage to the flyer bobbins 31 and thus the roving 4*a*. The necessary space requirement is kept to a minimum. The flyer bobbins 31 are suspended so as to be rotatably mounted. This makes it possible for the input roller pair 51 of the stretching unit 5 to draw off the roving 4*a* radially in a twist-free manner.

Figure 4:
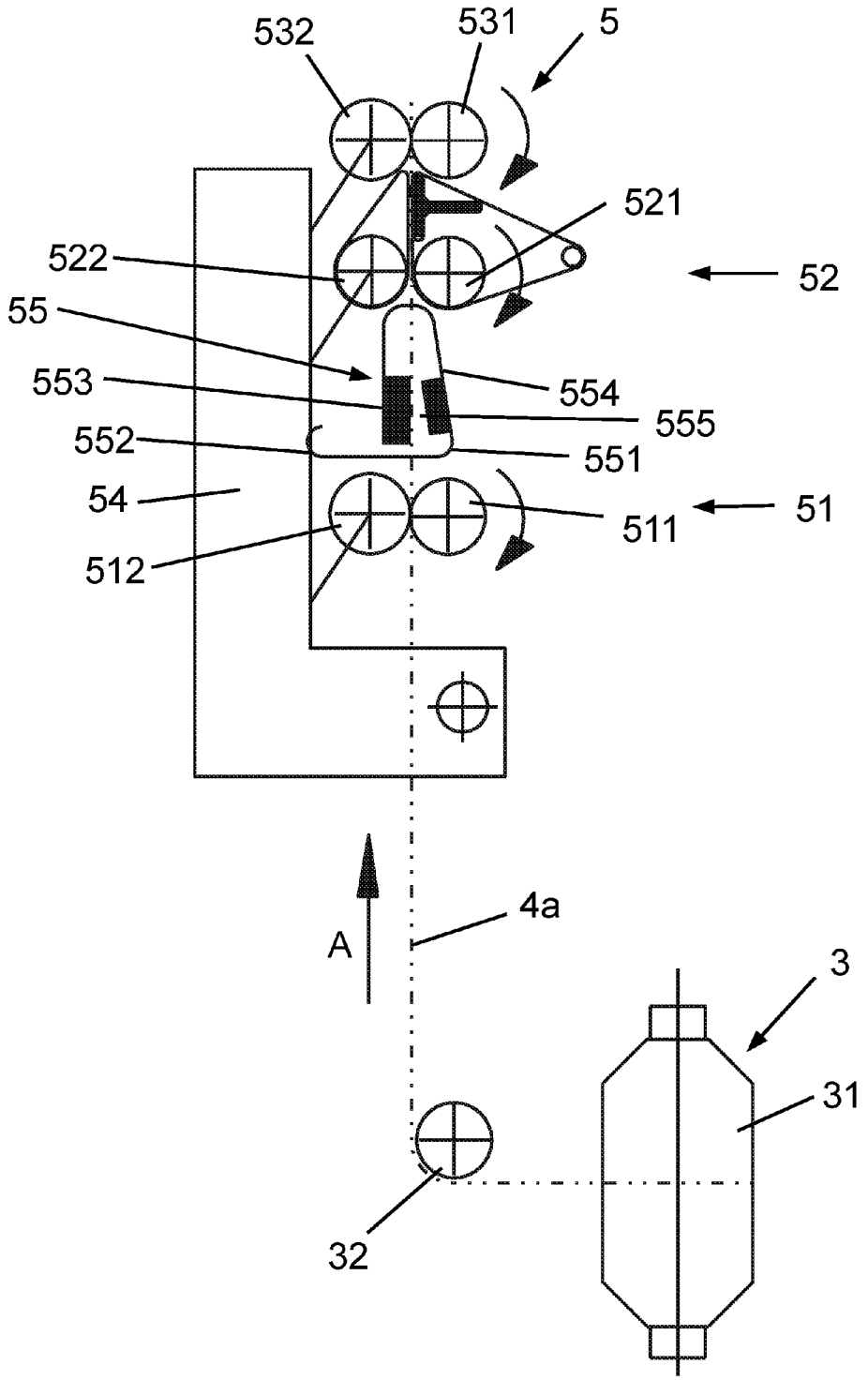
FIG. 4 schematically shows a detail of a further possible embodiment of the device according to the invention for producing knitted fabric, in which a sliver clamp is provided in the stretching unit, the device being shown in operation with the stretching unit lever closed and thus with the sliver grip open in the example shown.

FIG. 4 schematically shows a detail of an embodiment of the device 1 according to the invention. In the embodiment shown, a specially configured stretching unit 5 is used. In this stretching unit 5, a sliver clamp is provided between the input roller pair 51 and the intermediate roller pair 52. The sliver clamp 55 comprises a curved resilient body 551, which comprises a bracket 552, which strikes against the stretching unit lever 54 when the stretching unit lever 54 is closed, and two clamp arms 553, 554 for the roving 4*a*. The clamp arms 553, 554 extend through the stretching unit 5 in the roving conveying direction A.

The curved resilient body 551 is of a shape such that when the stretching unit lever 54 is closed, as shown in FIG. 4, one of the clamp arms 554 is splayed by the sliver, in such a way that an open gap 555, through which the sliver or the roving 4*a* can be conveyed, is formed between the clamp arm 553 and the clamp arm 554.

Figure 5:
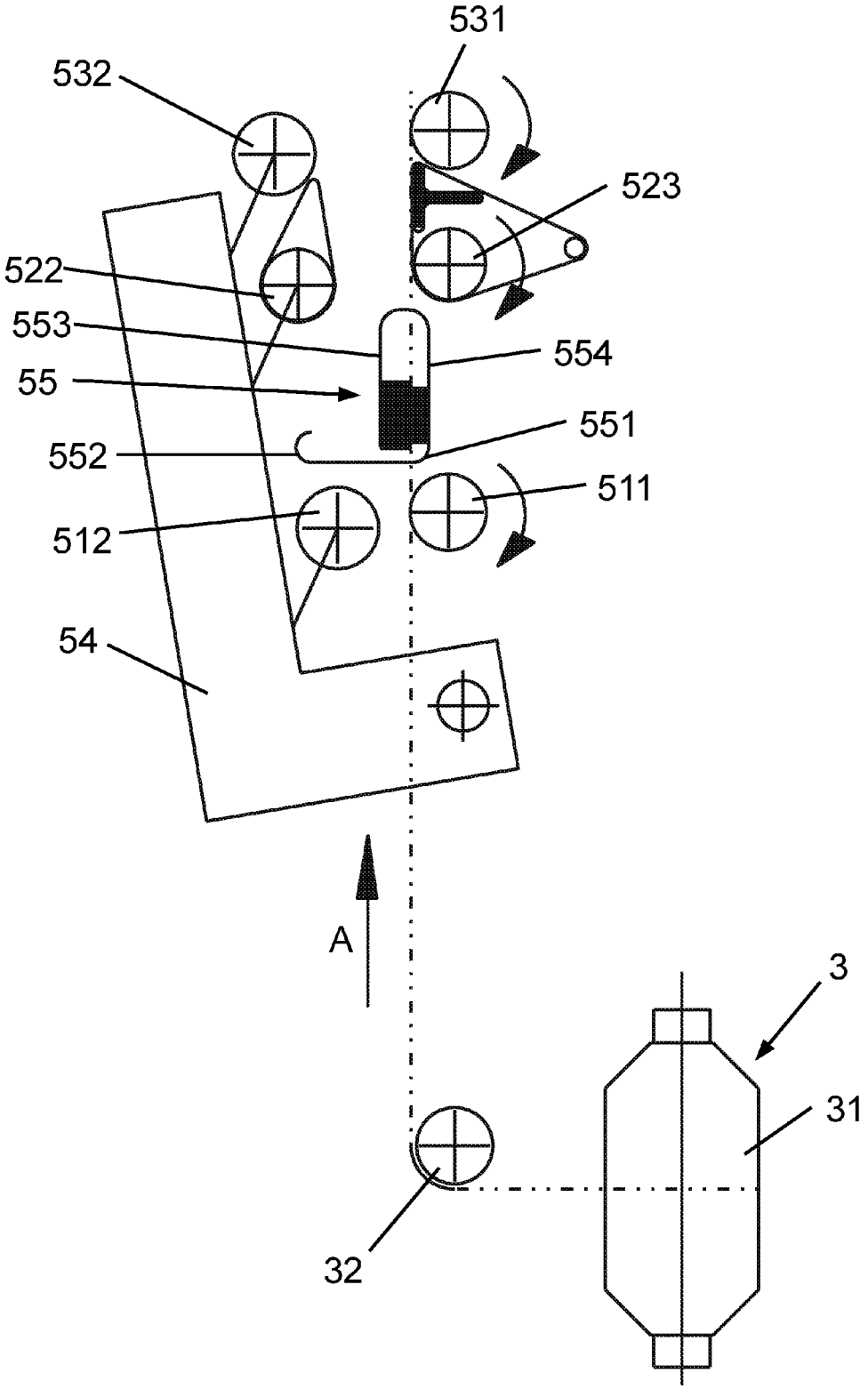
FIG. 5 schematically shows the embodiment of FIG. 4 with the stretching unit lever open and the sliver grip thereby closed.

FIG. 5 shows the arrangement of FIG. 4 when the stretching unit lever 54 is open. In this position, the nip rolls 512, 522, 532 provided on the stretching unit lever 54 no longer press against the drive rollers 511, 521, 531. Further, the stretching unit lever 54 no longer presses against the end of the bracket 552 of the sliver clamp 55. The bracket 552 is released. As a result of the released tension of the curved resilient body 551, the clamp arms 553, 554 close, in such a way that the sliver, in other words the roving 4*a*, is gripped between the clamp arms 553, 554.

In this way, the sliver or roving 4*a* can be secured when the stretching unit 5 is open, in spite of the stretching unit 5 being arranged in a vertical orientation. There is thus no risk of the roving 4*a* falling down under the force of gravity when the stretching unit lever 54 is open and causing the process to be interrupted.

The sliver clamp 55 is additionally configured in such a way that even when the stretching unit lever 54 is closed said clamp only opens and releases the sliver or roving 4*a* once there is sufficient contact force from the roller pairs of the stretching unit 5. In a preferred embodiment of the present invention, two sliver clamps 55 are provided for securing two slivers side by side. For this purpose, the two sliver clamps 55 are fixed to a rail in a modular construction.

Figure 6A:
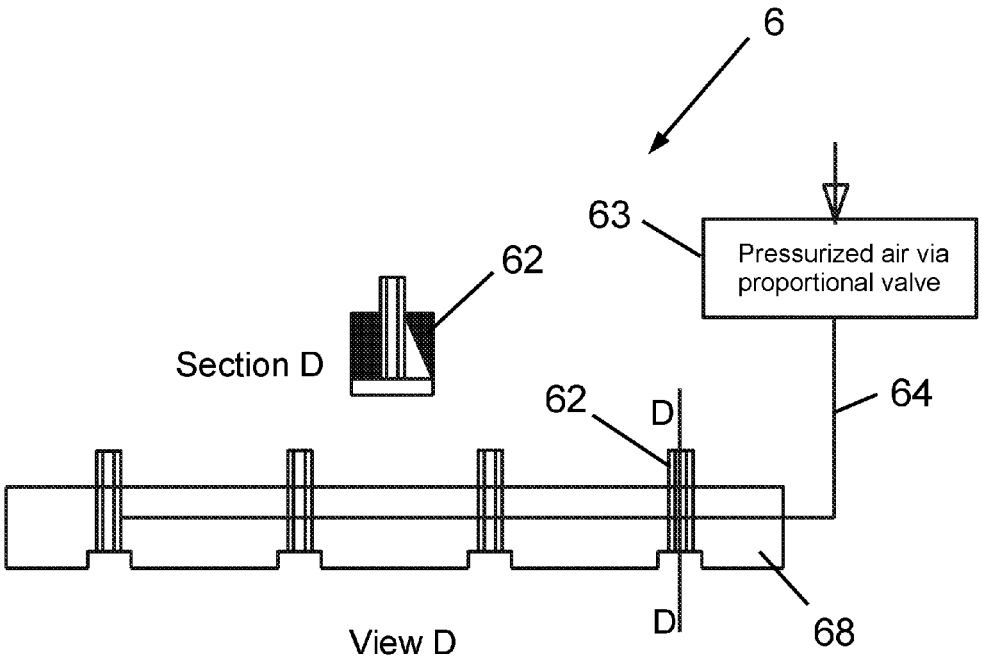
FIGS. 6*a* and 6 *b* schematically show an upper spinning nozzle arrangement, in a view D, and a lower spinning nozzle device, in a view E, of a spinning nozzle device which can be used in the device according to the invention for producing knitted fabric, the sections D and E each showing a spinning nozzle of the respective nozzle arrangement in a sectional side view.
Figure 6B:
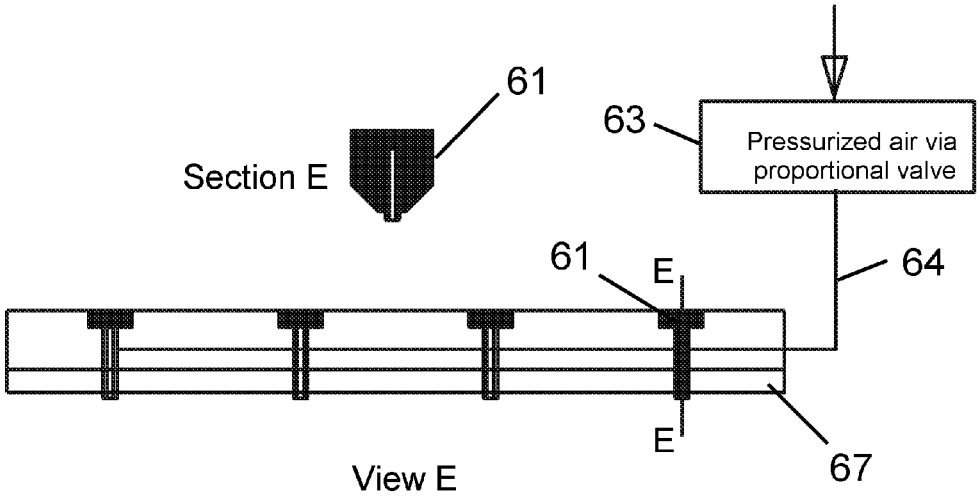

FIGS. 6*a* and 6*b* are schematic cross-sections through a spinning nozzle device 6 which can be used in the device 1 according to the invention. View D of FIG. 6*a* is a cross-section through a plurality of upper spinning nozzles 62 assembled to form a nozzle complex 68. In this context, section D of FIG. 6*a* is a cross-sectional view of one of these spinning nozzles 62. In FIG. 6*b*, view E is a cross-section through a nozzle complex 67 comprising lower spinning nozzles 61 arranged in series side by side, section E being a cross-section through one of these spinning nozzles 61. The nozzle complex 67 is located upstream from the nozzle complex 68 in the roving conveying direction A. In other words, the spinning nozzles 62 are downstream from the spinning nozzles 61.

Proportional valves 63 are integrated into the pressurised air supply 64 of both nozzle complexes 67, 68. The proportional valves 63 provide failure-free start-up and shutdown of the thread formation for further processing in a knitting machine 2.

The pressurised air supply 64 of the nozzle complexes 67, 68 is necessary before the start of the roving strengthening because of the short reaction times upon machine start-up. Without the interposed proportional valve 63 in the pressurised air feed, twisting would be produced by air jets even when the technical system was switched off. Because of the lack of supply of fibrous material by the stretching unit 5, there is overtwisting of the fibrous material already present in the nozzle system in the spinning nozzle 61 and the spinning nozzle 62. This rapidly leads to damage to and destruction of the newly formed strengthened roving. Failure-free start-up and shutdown of the knitting machine 2 is thus not possible in a case of this type. However, the proportional valve 63 makes it possible to control the air supply in proportion to the rotational speed of the air supply. In this context, the knitting machine 2 preferably provides the necessary rotational speed signal (see FIG. 16). As a result, according to the invention it is possible to start up and shut down the knitting machine 2 without damaging the fibrous material or the strengthened roving 4*b*.

Figure 7:
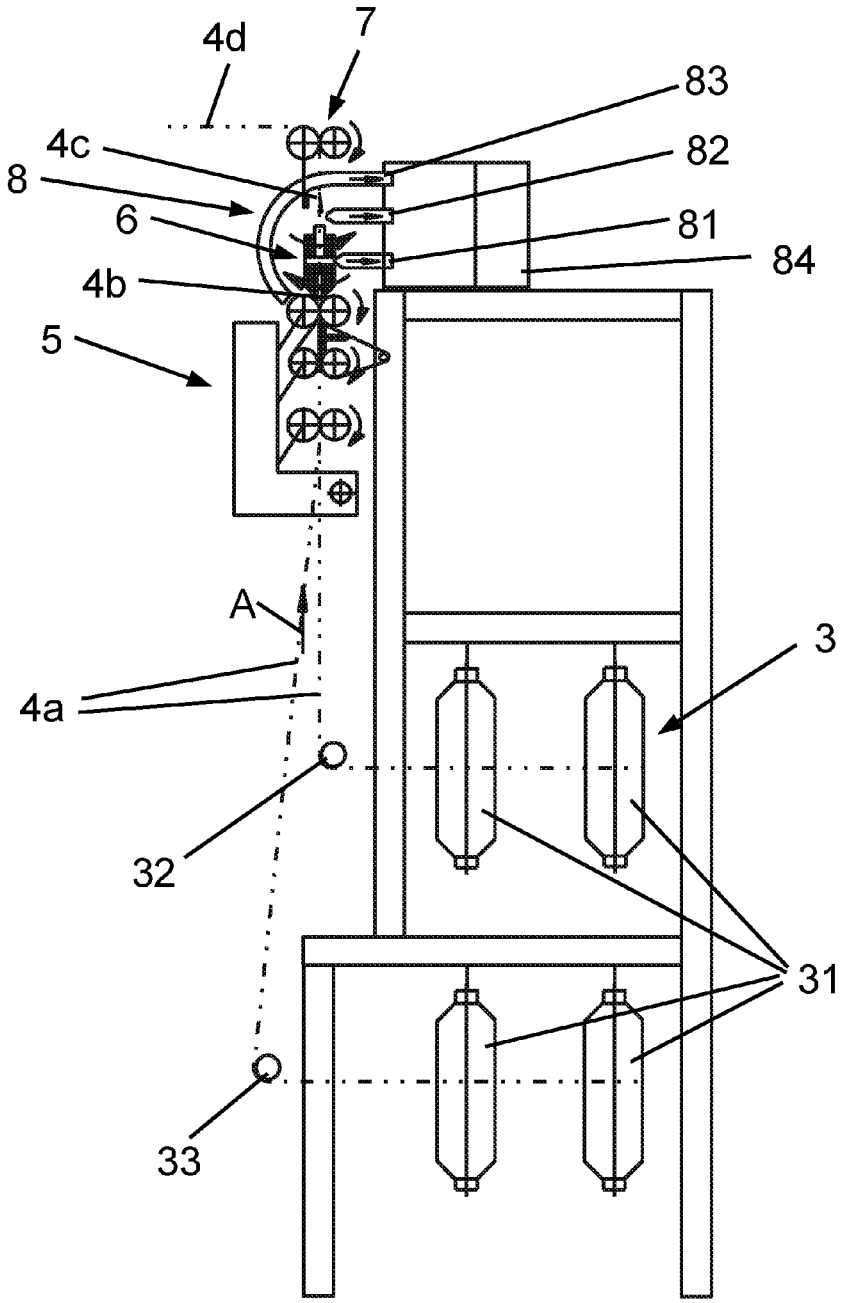
FIG. 7 schematically shows an embodiment of the device according to the invention for producing knitted fabric, comprising a device for keeping an upper region of the stretching unit and the spinning nozzle unit of the roving drawing and strengthening unit clean.

FIG. 7 schematically shows an embodiment of the device 1 according to the invention comprising a suction cleaning device 8. According to the invention, other suction cleaning devices may be used instead of the suction cleaning device 8 shown in FIG. 7.

As explained above, according to the present invention, the roving is strengthened by means of rotation provided by air jets in the spinning nozzle device 6. For this purpose, two spinning nozzles 61, 62 in series are provided downstream from the stretching unit 5 in the spinning nozzle device 6, as was also explained above. As a result of the technological process of roving strengthening using rotation provided by air jets, shorter fibres are sometimes completely cut off. These fibres are ejected by the airflow of the spinning nozzle 61 and the spinning nozzle 62 and form loose fibre. To keep the technical system clean and increase the performance of the device 1 according to the invention, loose fibres are removed by way of the suction cleaning device 8.

In the embodiment shown in FIG. 7, three suction cleaning units 81, 82, 83 are assigned to each spinning point. The suction unit 81 is arranged between the two spinning nozzles 61, 62. The suction unit 82 is downstream from the spinning nozzle device 6. The suction units 81, 82 are designed in such a way that they do not damage the treated roving 4*b* in the strengthening process on the spinning nozzle device 6.

The suction unit 83 provides defined cleaning of the nip rolls 532 of the output roller pair 53 of the stretching unit 5. In the embodiment of FIG. 7, all of the disclosed suction units 81, 82, 83 are assembled in an exhaust duct 84 and the loose fibre is discharged centrally. In this context, the exhaust duct 84 is preferably made conical so as to ensure uniform flow relationships over the width of the system.

Figure 8:
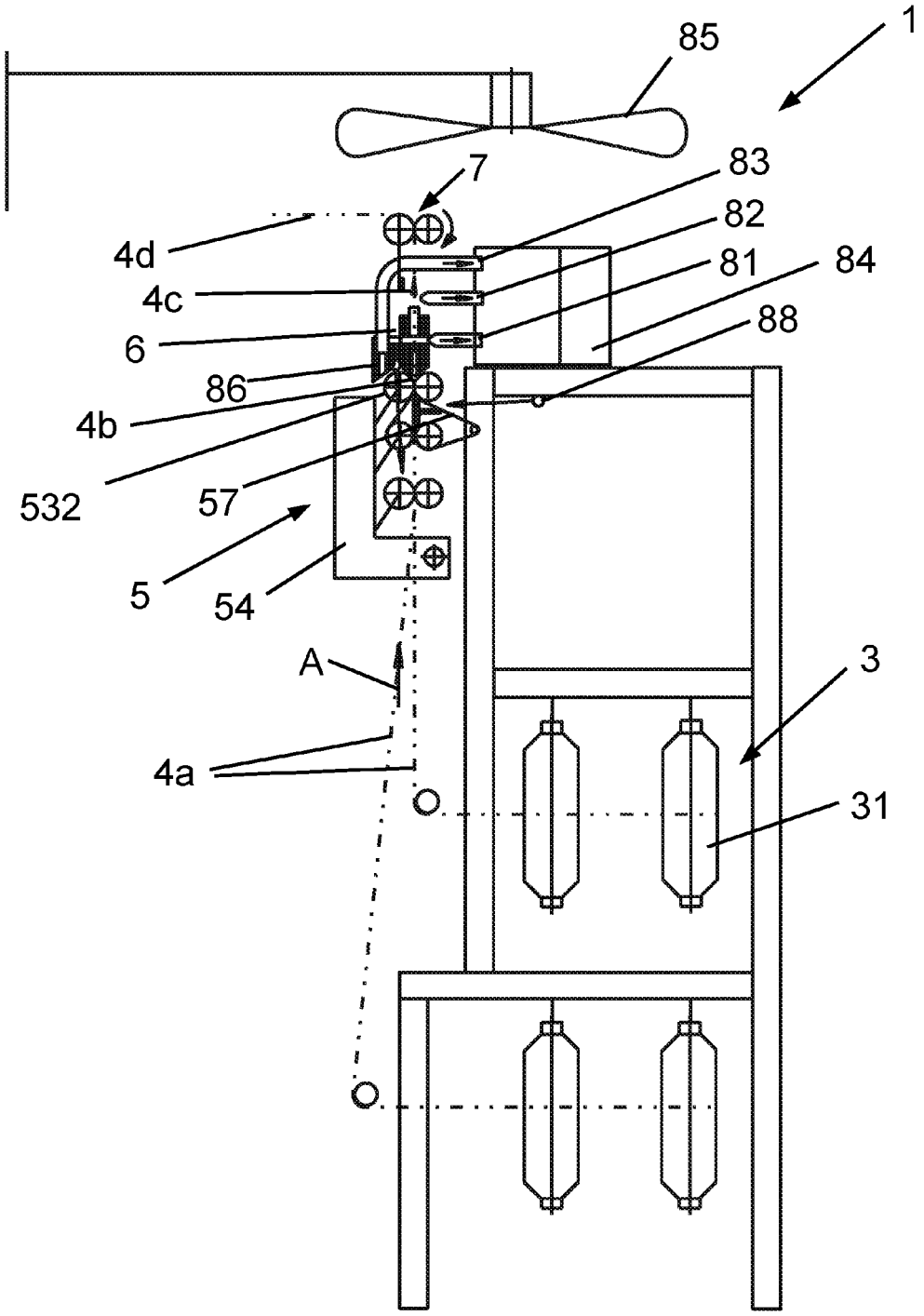
FIG. 8 schematically shows another, further possible variant configuration of the device according to the invention, in which the roving drawing and strengthening unit is equipped with means for keeping the roving drawing and strengthening tools clean.

As is shown schematically in FIG. 8, in accordance with a preferred embodiment of the device 1 according to the invention for general cleaning of the technical system for roving drawing and strengthening and of the knitting machine 2, it is provided that at least one ventilator device 85 comprising at least one rotating ventilator is mounted. The ventilator device 85 may be attached to the knitting machine and controlled ex works. The ventilator device 85 provides uniform distribution of the loose fibre which is not extracted. An accumulation of fibres, which might lead to process failure, is thus prevented. In this context, the region of the fibre stretching and the transition to the spinning nozzle 61 are to be protected from the penetration of air. To prevent air turbulence at said points—along with the effects of an undefined fibre amount at the stretching unit output, fluctuation in yarn fineness, and soiling of the device 1 due to additional loose fibre and accumulation of loose fibre and accompanying failure of the yarn production process—in the embodiment of the device 1 shown in FIG. 8, a cover device 86 for encasing the region from air turbulences is attached. The cover device 86 is for example in the form of a shaped part into which a blowing device explained in the following is advantageously also integrated.

For further increasing the stability of the device 1 according to the invention, blow-cleaning of operationally relevant points of the device 1 with pressurised air is provided. In this context, a blowing device 88 serves to blow off loose fibre in the rear part of the stretching unit 5. The air nozzles of this blowing device 88, which are arranged in series, are directed towards the strap 57 of the stretching unit 5. Each air nozzle of the blowing device 88 is arranged between two straps 57 at a defined distance from the intermediate shaft 521 of the intermediate roller pair 52 of the stretching unit 5. A further blowing device 87, mentioned above, serves to keep the front region of the stretching unit 5 clean. In this context, the air nozzles of this blowing device 87, which are arranged in series, are arranged between the nip rolls 532 of the stretching unit 5. They have the purpose of removing loose fibre and preventing the formation of lumps of fibre. In an advantageous embodiment of the invention, the disclosed blowing devices 87, 88 extend over half the width of the system. The pressurised air supply is subsequently implemented for both sides together in the middle of the system. In addition, it is advantageous for pressurised air to be applied to the blowing devices 87, 88 in time intervals. In this way, the pressurised air consumption can be reduced.

In conclusion, various exhausts for removing loose fibre and keeping clean the operating tools relevant to the process for the method for producing a knitted fabric can be provided on the device 1 according to the invention. It is thus recommended for the region between the suction nozzle and the torsion nozzle to be suction-cleaned, and for the region above the torsion nozzle to be suction-cleaned, and for the stretching unit output upper roller 532 to be suction-cleaned. In addition, it is expedient to provide a central exhaust duct 84, having a cross-sectional adaptation to the negative pressure supply, for the suction cleaning systems. It is also particularly favourable to integrate a screen drum filter having a ventilator, for generating negative pressure, and an automatic ejector for the waste fibres into each bar.

For blow-cleaning, both pressurised air pulse nozzles for the stretching unit side and pressurised air pulse nozzles in the region between the stretching unit lever (pendulum support) 54 and the lower rollers 511, 521, 531 of the stretching unit 5 may be provided. Rotating blow ventilators in the region of the needle cylinder of the knitting machine 2 and rotating blow ventilators in the region above the bars are also expedient.

Figure 9:
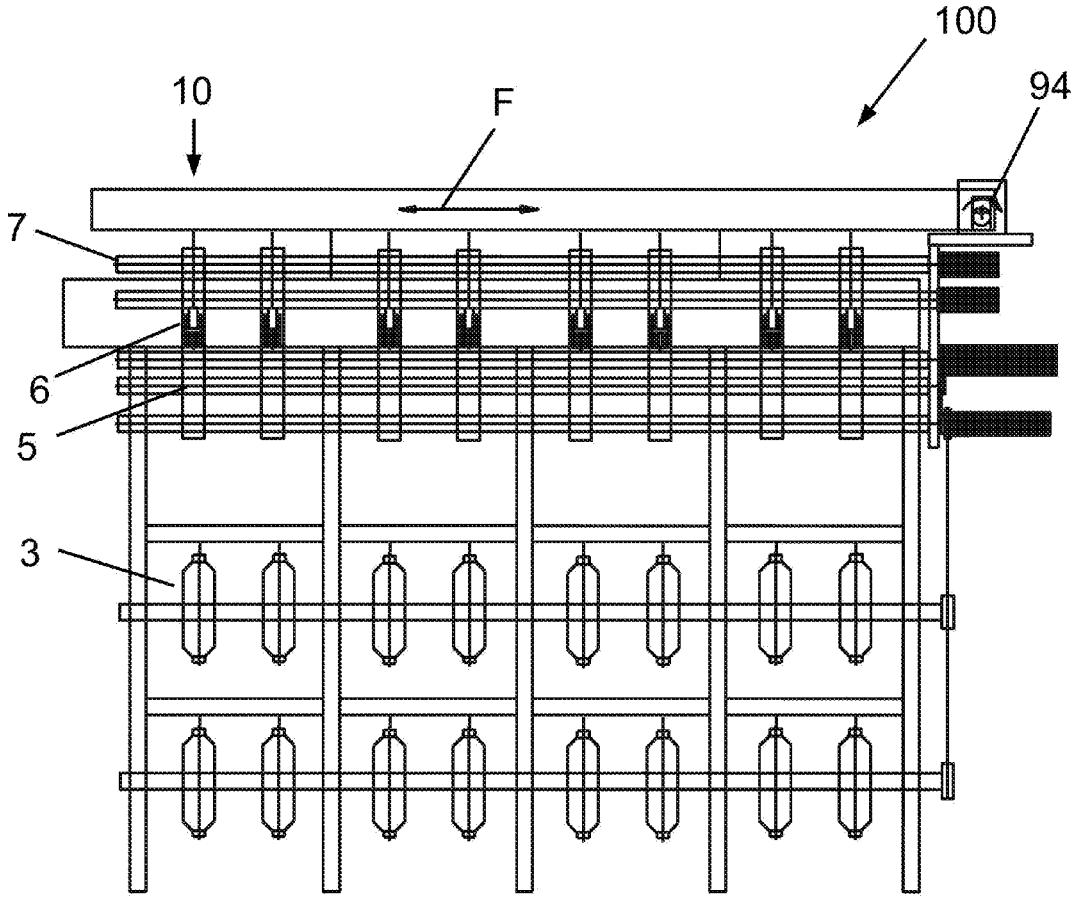
FIG. 9 schematically shows an embodiment of the device according to the invention for producing knitted fabric, in which changing of the spinning nozzle device is provided.

FIG. 9 schematically shows a possibility for changing the spinning nozzle device 6 in accordance with an embodiment of the device 1 according to the invention, in the movement directions indicated by the arrow F on a roving drawing and strengthening module 100 (bar).

As a result of the high production speeds during the roving strengthening, the components of the device 1 according to the invention are subjected to high loads. Accordingly, in an advantageous variant of the invention, it is provided that the spinning nozzle device 6 is changed as shown in FIG. 9, so as to be able to increase the performance of the device 1. As a result of the change, the spinning nozzles 61, 62 of the spinning nozzle device 6 can be moved transverse to the rollers of the stretching unit 5 of the individual roving drawing and strengthening units 10 which are arranged side by side, meaning that the roving 4*b* supplied to the spinning nozzles 61, 62 has varying contact with the rollers of the stretching unit 5, and thus wears them down uniformly and not just at a single point. In other words, the provided change results in the thread progression between the roller pairs of the stretching unit 5 and the gripping roller pair 7 changing in terms of time. This means that both the drawn roving and drawn, strengthened roving 4*b*, 4*c* are not in constant contact with the same contact area of the rollers. The rubber upper rollers 512, 522, 532, 72 are prevented from entering the stretching unit 5 and the gripping roller pair 7. In this context, reliable guidance of the roving 4*b*, 4*c* should always be ensured. This results in a defined changing path.

The changing shown in FIG. 9 preferably extends over a whole row of roving drawing and strengthening units 10 provided side by side, and can thus be implemented using a single drive 94.

Figure 10:
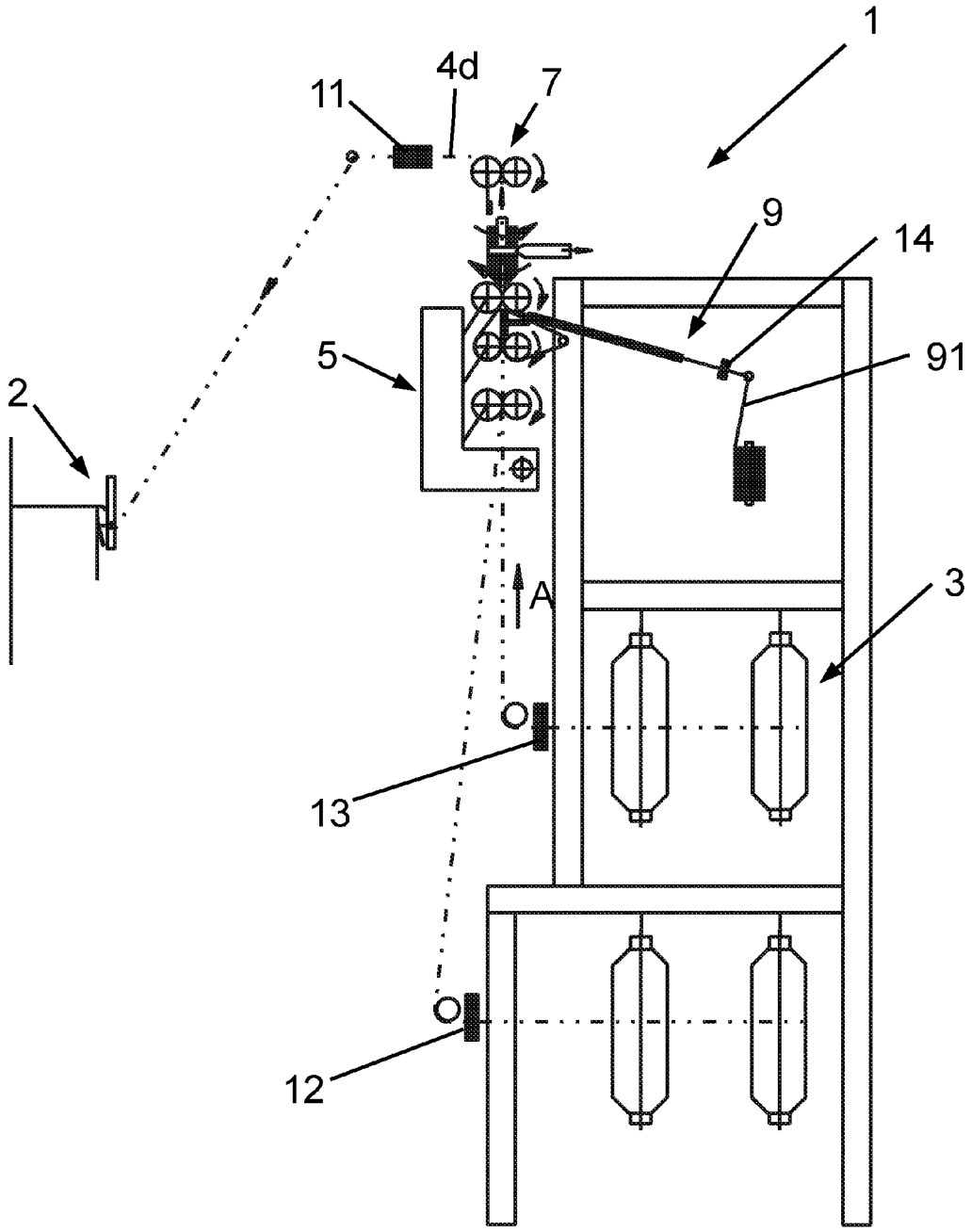
FIG. 10 schematically shows an embodiment of the device according to the invention for producing knitted fabric, in which various sensors for inspecting the individual treatment portions of the roving and for inspecting the auxiliary thread are provided.

FIG. 10 schematically shows an advantageous embodiment of the device 1 according to the invention, on which a plurality of sensors 11, 12, 13, 14 are used. By means of the sensors 11, 12, 13, 14, the process stability of the device 1 can be ensured and the performance of the technical system for roving drawing and roving strengthening can be increased, individual sub-steps of the method according to the invention being monitored by the sensors 11, 12, 13, 14.

Thus, for example, it is possible to arrange sensors 12, 13, which can detect a break in the flyer sliver or the roving 4*a*, on the flyer bobbins 31. Preferably, this is what is known as sliver skein monitoring, in which each sensor 12, 13 monitors all of the slivers (roving 4*a*) in a plane. In this context, the sensors 12, 13 are attached in such a way that they only detect the respective sliver if it falls down upon breaking. The presence of the roving 4*a* during the process is not inspected. In this context, the inspection point and the guide members of the roving 4*a* are selected in such a way that the end of a sliver (roving 4*a*) is also detected.

By means of the sensor 14 shown in FIG. 10, which is located in the auxiliary thread supply device 9, the feed of the auxiliary thread 91 to the stretching unit 5 can be monitored. The sensor 14 is a presence sensor. The sensor ensures the guaranteed presence of the auxiliary thread 91.

Figure 12:
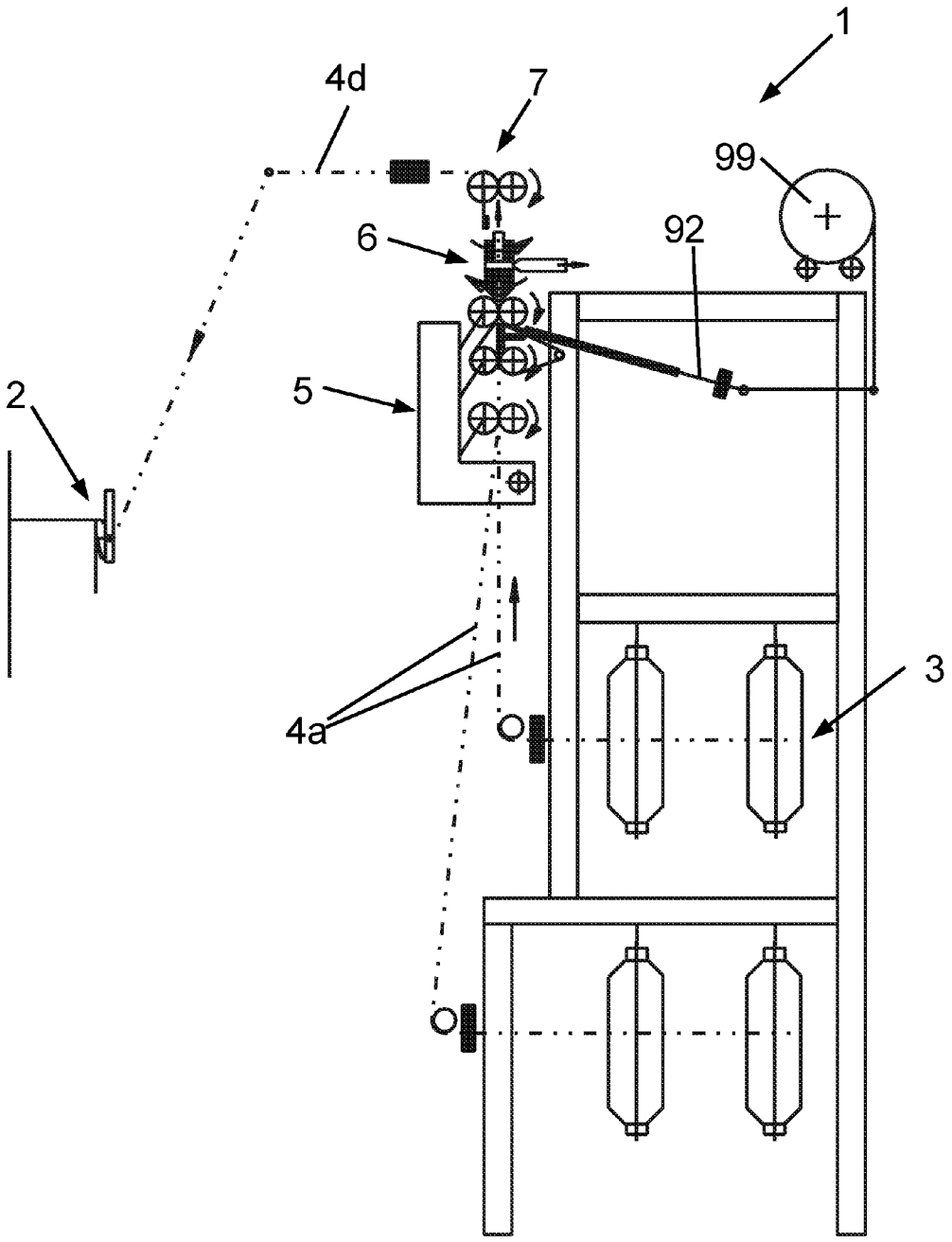
FIG. 12 schematically shows a variant configuration of the device according to the invention for producing knitted fabric, in which the roving drawing and strengthening unit is supplied with a resilient auxiliary thread.

Even if, as shown in FIG. 12, a resilient auxiliary thread 92 is used instead of an inflexible auxiliary thread 91, the feed thereof to the stretching unit 5 can be monitored using the sensor 14.

In the arrangement of FIG. 10, the drawn, strengthened roving 4*b* exiting the gripping roller pair 7 can be monitored by means of the sensor 11 provided downstream from the gripping roller pair 7. The sensor 11 serves to detect "thick points", cross-sectional enlargements and the presence of the drawn, strengthened roving 4*d*. This is single thread monitoring.

The sensors 11, 12, 13, 14 provided in the embodiment of FIG. 10 may also be supplemented by still further sensors (not shown). It is further possible for only individual ones of the sensors 11, 12, 13, 14 shown in FIG. 10 to be used in the device 1 according to the invention. Thus, on the device according to the invention, sensors may be provided for example for monitoring the knitting machine in relation to needle breaking, for sliver monitoring, preferably using one optical system for an entire bar, for pressurised air monitoring, for monitoring excess flow in the drives of the bar and in a replacement drive, for individual thread monitoring for the various stages of the roving treatment and of the auxiliary threads on the basis of a tension inspection, for individual thread monitoring in the different stages of the roving treatment and of the auxiliary threads on the basis of a thread movement, for individual thread monitoring in the different stages of the roving treatment and of the auxiliary threads in relation to thick points, for individual thread monitoring of the auxiliary thread or core thread, and for monitoring the negative pressure of the suction cleaning device. Preferably, the sensors 11, 12, 13, 14 are provided in such a way that when triggered they cause the knitting machine 2 and the roving drawing and strengthening unit 10 or the entire roving drawing and strengthening module 100 to be switched off.

Figure 11:
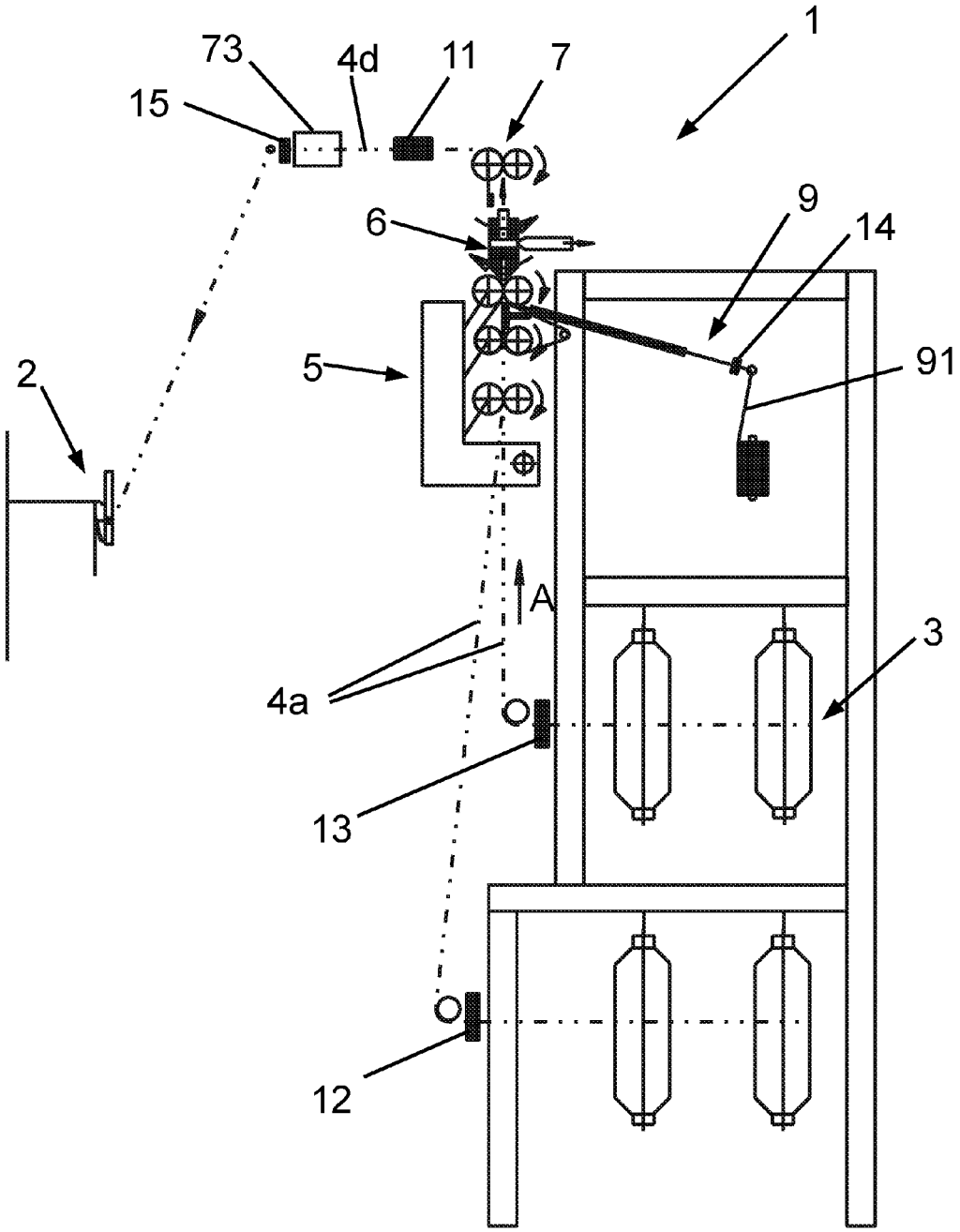
FIG. 11 schematically shows a configuration of the device according to the invention for producing knitted fabric, in which a feeding system is provided between the roving drawing and strengthening unit and the knitting needles of the knitting machine.

FIG. 11 schematically shows a development of the embodiment of the device 1 according to the invention shown in FIG. 10. Thus, in the example of FIG. 11, a fournisseur 73, in other words a positive or storage feeding system, is provided downstream from the gripping roller pair 7, for storing the newly formed drawn, strengthened roving 4*d*. A sensor 15 is downstream from the fournisseur 73. The sensor 15 is a presence sensor, which carries out single thread monitoring.

FIG. 12 schematically shows an embodiment of the device 1 according to the invention, in which a resilient auxiliary thread 92 is supplied to the stretching unit 5. The spandex thread feed comprises a separate drive 99 for this purpose. In this way, a highly resilient, preferably polyfil or multifil auxiliary thread 92 can be supplied to the stretching unit 5 at a defined tension.

Figure 13:
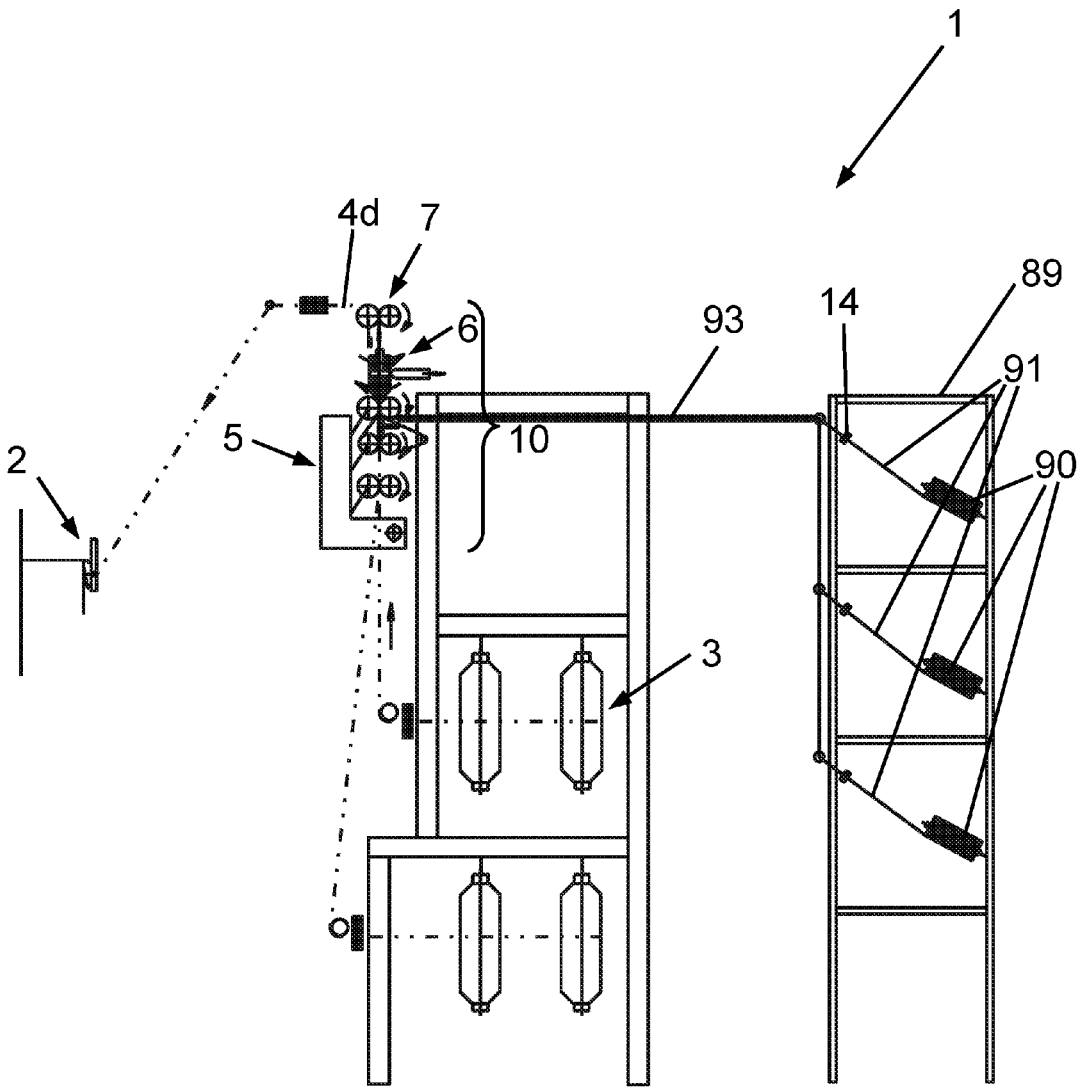
FIG. 13 schematically shows an embodiment of the device according to the invention for producing knitted fabric in which the auxiliary thread is provided on supply bobbins arranged in a bobbin creel.

FIG. 13 schematically shows a variant of the device 1 according to the invention, in which the auxiliary thread 91 is released from storage to produce a core/sheath roving. The auxiliary thread is supplied by a spool creel. The auxiliary thread is supplied via a system of tubes 93 as far as the point where the auxiliary thread 91 is integrated into the thread formation process. A presence sensor 14 carries out the individual thread monitoring.

Suitable protection from loose fibre is implemented by way of an enclosure 89. The separation of the auxiliary thread 91 and the technical system of the roving drawing and strengthening unit 10 is expedient exclusively for starting knitting, especially if the auxiliary thread 91 is used. This separation makes it possible to set all of the operational systems of a knitting machine 2 in operation using few auxiliary threads 91. As a result of the possibility of using larger supply bobbins 90 for the auxiliary threads 91, the performance is increased.

Figure 14:
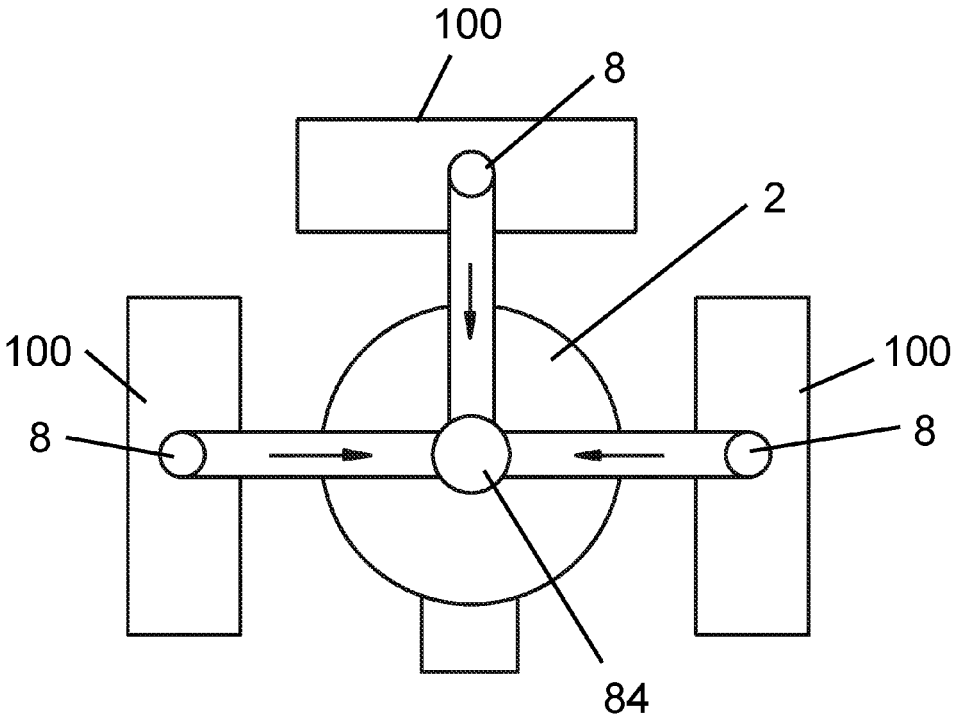
FIG. 14 is a schematic plan view of a circular knitting machine, which is supplied with drawn, strengthened roving by roving drawing and strengthening modules arranged around the circular knitting machine by the method according to the invention, extractor devices which open into an extractor duct being provided both above the circular knitting machine and above the roving drawing and strengthening modules.

FIG. 14 is a schematic plan view of a knitting machine 2 in the form of a circular knitting machine, which is supplied with drawn, strengthened roving 4*d* from three sides by roving drawing and strengthening units 10, which are assembled in series to form the roving drawing and strengthening modules 100. Both above the knitting machine 2 and above the roving drawing and strengthening modules 100 there are suction cleaning devices 8 which in the embodiment shown are assembled to form a single extractor duct 84.

An arrangement of this type, as shown in FIG. 14, makes it possible for example to supply 86 knitting points. A distance of up to 1.5 m between the circular knitting machine 2 and the roving drawing and strengthening modules 100 is possible without confinement and thread storage.

The roving drawing and strengthening modules 100 are multi-system bars, on which the stretching units 5 of a number of roving drawing and strengthening units 10 are provided. The roving drawing and strengthening modules 100 or bars are in the form of compact constructional units, in which all of the operating tools for thread formation, which includes the storage for the roving 4*a* in the form of flyer bobbins 31, are integrated. Preferably, the roving drawing and strengthening modules 100 or the bars are electronically coupled to the knitting machine 2, such as for example a circular knitting machine. As can be seen from FIGS. 14 and 15, two or three bars can be assigned to each circular knitting machine.

Figure 15:
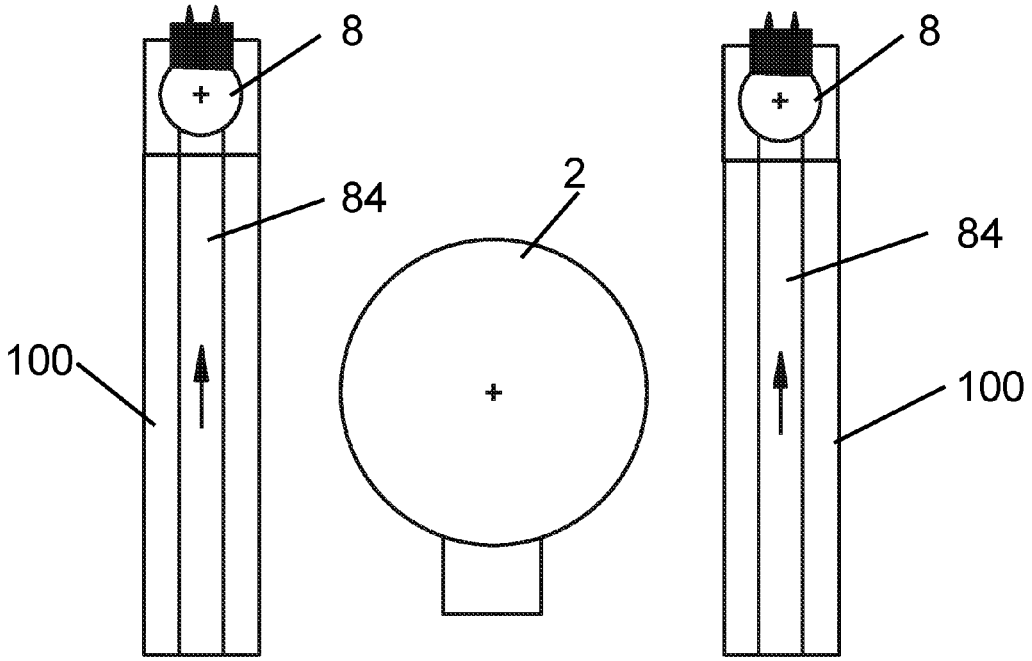
FIG. 15 is a schematic plan view of a circular knitting machine which is supplied with drawn, strengthened roving from two roving drawing and strengthening modules arranged opposite one another, each of the roving drawing and strengthening modules comprising an extractor duct which opens into an extraction system integrated into the system.

Separate auxiliary drives for supplying the flyer yarn to the stretching unit 5 may also be provided on the roving drawing and strengthening modules 100. It is also particularly helpful if operating aids for flyer sliver handling during maintenance and adjustment of the stretching unit 5 are provided. The above-disclosed sliver clamp 55 may for example be used for this purpose. Typically, the roving drawing and strengthening modules 100 also comprise changing of the sliver and the spinning nozzles 61, 62 relative to the stretching unit 5. Moreover, integrated suction cleaning technology is typically provided on roving drawing and strengthening modules 100 of this type according to the invention, and may be configured as in FIG. 14 or else as shown in FIG. 15. However, other variant embodiments of the suction cleaning system are also possible.

On the roving drawing and strengthening modules 100, the spinning nozzles 61, 62 are typically assembled in the form of nozzle complexes 67, 68, which are located between the stretching unit 5 and the gripping roller pair 7. The nozzle complexes 67, 68 are in the form of nozzle bars, which may for example be formed as in FIG. 6. On the roving drawing and strengthening modules 100, the thread may be guided from the gripping roller pair 7 to the thread guide 21 of the knitting machine 2 directly or with a fournisseur 73 interposed as shown in FIG. 10.

FIG. 15 is a schematic plan view of a knitting machine 2 in the form of a circular knitting machine, on which two roving drawing and strengthening modules 100 are provided arranged opposite one another, and supply the knitting machine 2 with drawn, strengthened roving 4*d*. A distance of up to 1 m between the respective roving drawing and strengthening modules 100 and the circular knitting machine 2 is possible without a thread storage device. The loose fibre, which accumulates up until the thread is formed, is systematically collated in an extractor duct 84, collected into a system-integrated suction cleaning device 8, and periodically separated out.

FIG. 16 schematically shows a possible interface configuration for coupling a circular knitting machine comprising roving drawing and strengthening modules 100 to form quasi-virtual threads for the method according to the invention for producing a knitted fabric on the device 1 according to the invention. In this context, the knitting machine 2, which may for example be a large circular knitting machine, is used as a master which communicates with at least one roving drawing and strengthening module 100 and which serves as a spinning unit. An operating unit 16 is preferably provided on the roving drawing and strengthening module 100. The knitting machine 2 is driven by a drive 22.

A whole row of drives are provided on the roving drawing and strengthening module 100. Thus, a drive 97 serves as the drive for the input shaft 511 and the intermediate shaft 521 of the stretching unit 5, thus providing defined drawing of the fibrous material, and also for the two transport shafts 32, 33 which provide failure-free access of the roving to the stretching unit 5. The input shaft 511 of the input roller pair 51 of the stretching unit 5 and the intermediate shaft 521 of the intermediate roller pair 52 of the stretching unit 5 are rigidly interconnected at a defined transmission ratio, for example by way of a toothed belt. The transport shafts 32, 33 are also preferably coupled using a toothed belt and linked to the aforementioned drive 97. A further drive 96 serves as a drive for the driven gripping roller 71, and provides defined transport of the drawn, strengthened roving 4*d*. The next drive 99 serves as a separate drive for supplying spandex thread to the stretching unit 5, meaning that a defined biasing force of the resilient thread 92 can be set during feeding to the stretching unit 5. Thus, the drive 99 can provide a feed having an adjustable speed.

In the schematic drawing of FIG. 16, the circular knitting machine 2 forms the master process for the electronic coupling of the roving drawing and strengthening modules 100 via a control system provided in the circular knitting machine. In this context, the individual drive 96 of the output shaft 531 of the stretching unit 5 communicates with the integrated control system of the circular knitting machine. The individual drive 97 of the mechanically coupled stretching unit input and central rollers 511, 521 communicates with the drive 96 of the stretching unit output roller 531. The stretching unit drawing can be programmed as desired. The coupling ratio between the circular knitting machine 2 and the individual roving drawing and strengthening modules 100 can also be programmed as desired.

The stretching unit input roller 511 drives conveying rollers for flyer slivers on the basis of a mechanical coupling. A separate drive is provided for the replacement device. A ventilator for generating the negative pressure for keeping the system clean switches on once a programmed minimum rotational speed of the circular knitting machine has been achieved. The coupling ratio applies to the whole range of rotational speeds, including inching operation and including the proportional valves for nozzle control.

Further, the proportional valves 63, shown for example in FIG. 6, of the spinning nozzles 61 and 62 can be actuated by way of the roving drawing and strengthening module 100. Moreover, it is advantageous if the blow-cleaning technology, the aspiration of the device 1 and the sensors 11, 12, 13, 14, 15 are actuated by the by way of the roving drawing and strengthening module 100.

By way of the variants, shown in the drawings by way of example, of the device 1 according to the invention, which can also be modified in accordance with the respective requirements, the method according to the invention can be carried out. By way of the method according to the invention, knitted materials, predominantly made of cotton fibres, can be produced. In this context, the roving 4*a* is supplied in the form of flyer slivers or stretch belts. The roving 4*b*, which is drawn in the stretching unit to form fibre belts, is, as disclosed above, passed through a two-stage spinning nozzle device 6 arranged in series and having opposite directions of rotation of the spinning nozzles 61, 62. In this context, the spinning nozzle device 6 is located in a portion between the stretching unit output rollers 531, 532 and the fibre gripping point provided by the gripping roller pair 7. By way of the spinning nozzle device 6, defined fibre strengthening is carried out whilst ensuring a tension between the stretching unit output rollers 531, 532 and the fibre gripping point, which is dependent on the process and the fineness. The fibre strengthening which is achieved makes it possible to transport the drawn, strengthened roving 4*d* exiting the gripping roller pair 7 in the form of a thread-like formation over longer distances from the gripping point to the thread guide whilst using conventional thread eyes, and to process it reliably on the knitting machine 2 at a medium tension. As discussed above, a multi-system circular knitting machine for example may be used as the knitting machine 22.

The method according to the invention is characterised by independent tension regulation between the spinning nozzle device 6 and gripping roller pair 7 on the one hand and between the gripping roller pair 7 and the thread guide 21 on the other hand.

Further, in the method according to the invention, the degree of rotation in the thread can preferably be adjusted by way of the pressure level of the spinning nozzles 61, 62 and the nozzle geometry of the spinning nozzles 61, 62 of the spinning nozzle device 6.

If, as is also explained above, an inflexible thread (core thread) 91 is integrated into the fibre belt formed in the stretching unit 5, a very low degree of rotation can be set at the spinning nozzles 61, 62, and results in great softness of the drawn, strengthened roving 4*c* exiting the spinning nozzle device 6.

By way of the method according to the invention, it is possible to achieve novel knitted fabric properties, such as particularly great softness and a particularly intense lustre, as a result of the extremely extensive parallel fibre layer of the drawn, strengthened roving 4*d* which is used for the knitting.

If an inflexible thread (core thread) 91 is integrated into the drawn, strengthened roving 4*c*, this leads to an increase in the process stability of the method according to the invention. However, it is also possible to integrate resilient auxiliary threads 92 into the fibre belts.

Particularly good method results can be achieved if the region between the spinning nozzles 61, 62 is suction-cleaned.

The method according to the invention can be carried out highly flexibly, it being possible to meter the fibre supply continuously and thus to derive different material qualities with a constant pattern.

The method according to the invention can be carried out on a device 1 with a relatively small space requirement. The investment required for devices 1 of this type and the specific energy requirement are much lower than in conventional technologies comprising separate processes for plane formation and thread formation.

The invention claimed is:

1. Device (1) for producing knitted fabric, comprising a knitting machine (2) and at least one roving drawing and strengthening unit (10), which has a roving supply unit (3), by means of which a roving (4*a*) can be provided in the form of a fibre bundle that has not been strengthened, a stretching unit (5), to which the roving (4*a*) can be fed in a roving conveying direction (A) in the form of at least one sliver, and a spinning nozzle device (6), by means of which pressurised air can be applied to a drawn roving (4*b*) exiting the stretching unit (5) in a fibre strengthening segment (60), characterised in that a gripping roller pair (7), which delimits the fibre strengthening segment (60) and of which the gripping rollers (71, 72) can be rotated in opposite directions, is provided downstream from the spinning nozzle device (6), the gripping roller pair (7) forming a clamping passage for the drawn, strengthened roving (4*c*) exiting the spinning nozzle device (6), and a feed to the knitting machine (2) for the drawn, strengthened roving (4*d*) exiting the gripping roller pair (7) being provided after the gripping roller pair (7), proportional valves (63), by means of which the pressurised air supply can be set in proportion to the roving conveying speed of the roving drawing and strengthening unit (10), are integrated into the pressurised air supply of spinning nozzles (61, 62) of the spinning nozzle device (6);

a plurality of roving drawing and strengthening units (10) assembled in series to form a roving drawing and strengthening module (100), wherein the proportional valves (63) of the spinning nozzles (61, 62) can be actuated by way of the roving drawing and strengthening module (100), and the knitting machine (2) performing a master function for the roving drawing and strengthening module (100) so that the knitting machine (2) can provide the necessary rotational speed signal to regulate the air supply to the spinning nozzle device (6) to be proportional to the rotational speed.

2. Device according to claim 1, characterised in that the distance between the spinning nozzle device (6) and the gripping roller pair (7) is in a range of 10 cm to 25 cm.

3. Device according to claim 1, characterised in that the distance between the gripping roller pair (7) and the knitting needles (20) of the knitting machine (2) is in a range of 1 m to 2.5 m.

4. Device according to claim 1, characterised in that the spinning nozzle device (6) comprises spinning nozzles (61, 62) which automatically convey the drawn roving (4*b*) in the roving conveying direction (A).

5. Device according to claim 1, characterised in that the spinning nozzle device (6) comprises two pneumatically operating spinning nozzles (61, 62) having opposite directions of rotation, which are arranged in succession in the roving conveying direction (A).

6. Device according to claim 1, characterised in that spinning nozzles (61, 62) of the spinning nozzle device (6) can be changed laterally.

7. Device according to claim 1, characterised in that a suction unit (81, 82, 83) is provided in each case between the spinning nozzles (61, 62) of the spinning nozzle device (6), downstream from the spinning nozzle device (6), and on an output roller pair (53) of the stretching unit (5), the outputs of the suction units (81, 82, 83) being combined into an extraction duct (84).

8. Device according to claim 7, characterised in that the extraction duct (84) is conical in form.

9. Device according to claim 1, characterised in that a rotating ventilator device (85) is provided on the device (1) and a region around the spinning nozzle device (6) and/or around the stretching unit (5) is protected against air turbulences by a cover device (86).

10. Device according to claim 1, characterised in that blowing nozzles (87), which can be operated in time intervals, are provided on the spinning nozzle device (6) and/or on the stretching unit (5).

11. Device according to claim 1, characterised in that the stretching unit (5) is coupled to an auxiliary thread supply device (9) for supplying at least one auxiliary thread (91, 92).

12. Device according to claim 11, characterised in that the proportion by mass of the auxiliary thread (91, 92) in the drawn, strengthened roving (4*d*) exiting the gripping roller pair (7) is 5 to 25%.

13. Device according to claim 11, characterised in that the auxiliary thread supply device (9) comprises a tube system (93) through which at least one auxiliary thread (91) can be supplied to the stretching unit (5).

14. Device according to claim 11, characterised in that the auxiliary thread is a spandex thread (92) and the auxiliary thread supply device (9) comprises a separate drive (99), in such a way that the spandex thread (92) can be supplied to the stretching unit (5) at a defined tension.

15. Device according to claim 1, characterised in that at least one sensor (11, 12, 13, 14) for detecting the presence, thickness or tension of the roving (4*a*, 4*c*) is provided on at least one transport segment of the roving (4*a*), of the drawn, strengthened roving (4*c*) from the roving supply unit (3) to the stretching unit (5) or from the gripping roller pair (7) to the knitting machine (2).

16. Device according to claim 1, characterised in that a sliver clamp (55), which clamps the sliver when a stretching unit lever (54) is open and releases the sliver when the stretching unit lever (54) is closed, pressing the nip rolls (512, 522, 532) of the stretching unit (5) against the drive rollers (511, 521, 531) of the stretching unit (5), and which comprises a curved resilient body (551), is provided between rollers (511, 512; 521, 522; 531, 532) of the stretching unit (5).

17. Device according to claim 1, characterised in that the roving drawing and strengthening unit is formed in such a way that the roving (4*a*, 4*b*, 4*c*) is supplied from the roving supply unit (3) to the gripping roller pair (7) from bottom to top, in other words counter to gravity.

18. Device according to claim 17, characterised in that the feed to the knitting machine (2) for the drawn, strengthened roving (4*d*) exiting the gripping roller pair (7) is provided sufficiently far up on the device (1) for the drawn, strengthened roving (4*d*) to be fed to the knitting machine (2) overhead.

19. Device according to claim 1, characterised in that the knitting machine (2) is a circular knitting machine and at least two roving drawing and strengthening modules (100) are provided around the circular knitting machine, and the control systems of the circular knitting machine and of the roving drawing and strengthening modules (100) are coupled together.

20. Device according to claim 1, characterised in that a fournisseur (73) is provided between the gripping roller pair (7) and a thread guide of the knitting machine (2) for storing the thread.

21. Device according to claim 1, characterised in that at least one sensor (11, 12, 13, 14) for detecting the presence, thickness or tension of the auxiliary thread (91, 92) is provided on at least one transport segment of the roving (4*a*) of the auxiliary thread (91, 92) from the roving supply unit (3) to the stretching unit (5) or from the gripping roller pair (7) to the knitting machine (2) and in the auxiliary thread supply device (9).

* * * * *